US008035662B2

(12) United States Patent
Yajima et al.

(10) Patent No.: US 8,035,662 B2
(45) Date of Patent: Oct. 11, 2011

(54) INTEGRATED CIRCUIT DEVICE AND ELECTRONIC INSTRUMENT

(75) Inventors: Hidehiko Yajima, Suwa (JP); Hiroshi Kiya, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 969 days.

(21) Appl. No.: 11/984,076

(22) Filed: Nov. 13, 2007

(65) Prior Publication Data

US 2008/0117234 A1 May 22, 2008

(30) Foreign Application Priority Data

Nov. 22, 2006 (JP) ..... 2006-315705
Nov. 22, 2006 (JP) ..... 2006-315706

(51) Int. Cl.
*G09G 5/10* (2006.01)

(52) U.S. Cl. ..... 345/690; 345/206

(58) Field of Classification Search ..... 345/87–102, 345/204–206
See application file for complete search history.

(56) References Cited

U.S. PATENT DOCUMENTS 5,706,024 A * 1/1998 Park ..... 345/96
7,123,231 B2 * 10/2006 Honda ..... 345/96
7,224,224 B2 * 5/2007 Sera et al. ..... 330/253
2002/0011998 A1 1/2002 Tamura
2007/0001973 A1 1/2007 Kumagai et al.
2007/0001982 A1 1/2007 Ito et al.
2007/0002061 A1 1/2007 Kumagai et al.
2007/0057826 A1 3/2007 Yajima et al.

FOREIGN PATENT DOCUMENTS

JP A 2001-222249 8/2001
JP A 2007-12869 1/2007
JP A 2007-43029 2/2007
JP A 2007-43030 2/2007
JP A 2007-43031 2/2007
JP A 2007-43032 2/2007
JP A 2007-43033 2/2007
JP A 2007-43034 2/2007
JP A 2007-43035 2/2007
JP A 2007-43036 2/2007
JP A 2007-65322 3/2007

* cited by examiner

*Primary Examiner* — Chanh Nguyen
*Assistant Examiner* — Roy Rabindranath
(74) *Attorney, Agent, or Firm* — Oliff & Berridge PLC

(57) ABSTRACT

An integrated circuit device includes a scan driver block, a high-speed interface circuit block, and a scan driver pad arrangement region in which pads electrically connecting scan output lines of the scan driver block and scan lines are disposed. The high-speed interface circuit block includes a physical layer circuit that receives data using differential signals, and a link controller that performs a link layer process. The scan output lines of the scan driver block are provided from the scan driver block to the scan driver pad arrangement region to pass over the link controller while avoiding the physical layer circuit. A common voltage line connecting first and second common voltage pads is provided from the first common voltage pad to the second common voltage pad along a first direction, the common voltage line being provided in a second direction with respect to the physical layer circuit along the first direction in an arrangement region of the physical layer circuit.

9 Claims, 24 Drawing Sheets

| A3 TO A0 (REGISTER ADDRESS) | REGISTER | GRAYSCALE ADJUSTMENT DATA |
|---|---|---|
| 0000 (0h) | R0 | DAR0 |
| 0001 (1h) | R1 | DAR1 |
| 0010 (2h) | R2 | DAR2 |
| ⋮ | ⋮ | ⋮ |
| 1110 (Eh) | RI | DARI |
| 1111 (Fh) | — | — |

INTEGRATED CIRCUIT DEVICE AND ELECTRONIC INSTRUMENT

Japanese Patent Application No. 2006-315706 and Japanese Patent Application No. 2006-315705, both filed on Nov. 22, 2006, are hereby incorporated by reference in their entirety.

BACKGROUND OF THE INVENTION

The present invention relates to an integrated circuit device, an electronic instrument, and the like.

In recent years, a high-speed serial transfer such as low voltage differential signaling (LVDS) has attracted attention as an interface aiming at reducing EMI noise or the like. In such a high-speed serial transfer, data is transferred by causing a transmitter circuit to transmit serialized data using differential signals and causing a receiver circuit to differentially amplify the differential signals.

An ordinary portable telephone includes a first instrument section provided with buttons for inputting a telephone number and characters, a second instrument section provided with a liquid crystal display (LCD) and a camera device, and a connection section (e.g., hinge) which connects the first and second instrument sections. Therefore, the number of interconnects passing through the connection section can be reduced by transferring data between a first circuit board provided in the first instrument section and a second circuit board provided in the second instrument section by a high-speed serial transfer using small-amplitude differential signals.

A display driver (LCD driver) is known as an integrated circuit device which drives a display panel such as a liquid crystal panel. In order to realize a high-speed serial transfer between the first and second instrument sections, a high-speed interface circuit which transfers data through a serial bus must be incorporated in the display driver (see JP-A-2001-222249).

On the other hand, since the high-speed interface circuit handles differential signals with a small voltage amplitude of 0.1 to 1.0 V, for example, the high-speed interface circuit tends to be affected by noise from other signal lines. In particular, when noise from a signal with a large amplitude (e.g., scan signal transmitted through a scan line) is transmitted to the high-speed interface circuit, a malfunction such as a transfer error may occur.

A display panel includes an array substrate in which thin film transistors (TFTs) are disposed in an array, and a common substrate on which a common electrode is formed. The display driver outputs a data signal (source signal) supplied to the source of the TFT and a scan signal (gate signal) supplied to the gate of the TFT. The display driver generates and outputs a common voltage (common electrode voltage) applied to the common electrode.

In this case, the voltage difference between the voltage of the data signal and the common voltage is applied to a liquid crystal element. Therefore, when the common voltage generated by the display driver does not reach the desired voltage due to parasitic resistance and the like, the voltage applied to the liquid crystal element does not reach the desired voltage, whereby the display quality deteriorates.

SUMMARY

According to one aspect of the invention, there is provided an integrated circuit device comprising:

at least one scan driver block that drives a plurality of scan lines of a display panel;

a high-speed interface circuit block that transfers data through a serial bus using differential signals; and a scan driver pad arrangement region in which a plurality of pads electrically connecting a plurality of scan output lines of the plurality of scan driver block and the scan lines are disposed;

the high-speed interface circuit block including:

a physical layer circuit that receives data using the differential signals; and a link controller that performs a link layer process; and the plurality of scan output lines as output lines of the scan driver block being provided from the scan driver block to the scan driver pad arrangement region to pass over the link controller while avoiding the physical layer circuit.

According to another aspect of the invention, there is provided an integrated circuit device comprising:

a common voltage generation circuit that generates a common voltage applied to a common electrode of a display panel;

a high-speed interface circuit block that includes a physical layer circuit and transfers data through a serial bus using differential signals; and first and second common voltage pads that output the common voltage generated by the common voltage generation circuit to the outside;

when a direction from a first side as a short side of the integrated circuit device toward a third side opposite to the first side is referred to as a first direction, a direction from a second side as a long side of the integrated circuit device toward a fourth side opposite to the second side is referred to as a second direction, a direction opposite to the first direction is referred to as a third direction, and a direction opposite to the second direction is referred to as a fourth direction, the first common voltage pad being disposed in the third direction with respect to the data driver block, and the second common voltage pad being disposed in the first direction with respect to the data driver block;

first and second differential input pads to which first and second signals forming the differential signals are input from the outside being disposed in the fourth direction with respect to the physical layer circuit; and a common voltage line connecting the first and second common voltage pads being provided from the first common voltage pad to the second common voltage pad along the first direction, the common voltage line being provided in the second direction with respect to the physical layer circuit along the first direction in an arrangement region of the physical layer circuit.

According to a further aspect of the invention, there is provided an electronic instrument comprising:

the above integrated circuit device; and a display panel driven by the integrated circuit device.

DETAILED DESCRIPTION OF THE EMBODIMENT

Figure 1:
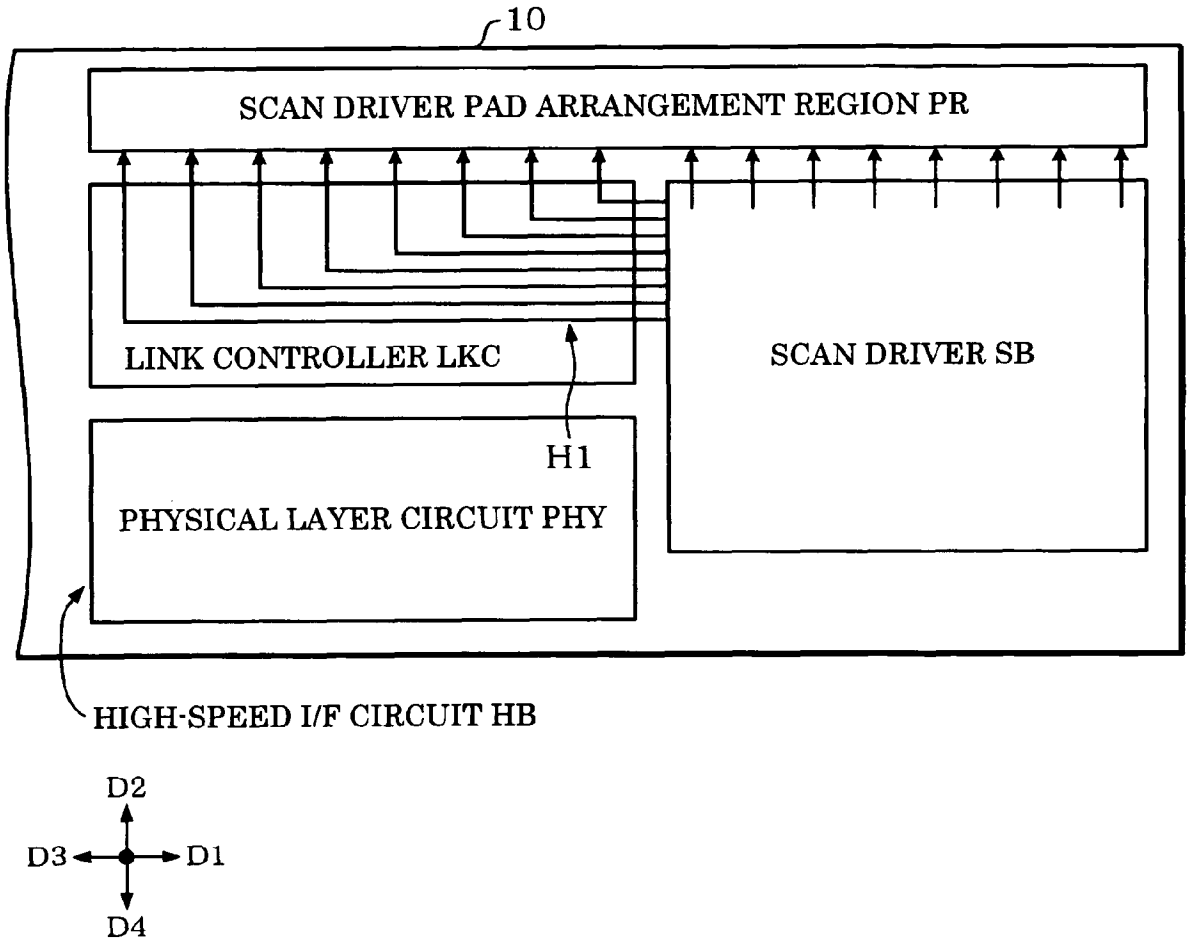
FIG. 1 shows an arrangement configuration example of an integrated circuit device using a scan output line wiring method according to one embodiment of the invention.

Aspects of the invention may provide an integrated circuit device which can prevent a malfunction and the like when incorporating a high-speed interface circuit, and an electronic instrument including the same.

Further aspects of the invention may provide an integrated circuit device in which a high-speed interface circuit can be incorporated while preventing deterioration in display quality, and an electronic instrument including the same.

According to one embodiment of the invention, there is provided an integrated circuit device comprising:

at least one scan driver block that drives a plurality of scan lines of a display panel;

a high-speed interface circuit block that transfers data through a serial bus using differential signals; and a scan driver pad arrangement region in which a plurality of pads electrically connecting a plurality of scan output lines of the plurality of scan driver block and the scan lines are disposed;

the high-speed interface circuit block including:

a physical layer circuit that receives data using the differential signals; and a link controller that performs a link layer process; and the plurality of scan output lines as output lines of the scan driver block being provided from the scan driver block to the scan driver pad arrangement region to pass over the link controller while avoiding the physical layer circuit.

According to this embodiment, since the high-speed interface circuit block is incorporated in the integrated circuit device, a high-speed serial transfer using the differential signals can be performed between the integrated circuit device and an external device. Since the integrated circuit device includes the scan driver block, it is necessary to provide a large number of scan output lines from the scan driver block to the scan driver pad arrangement region, and signal noise from the scan output lines may adversely affect the high-speed interface circuit block. According to this embodiment, the scan output lines of the scan driver block are provided to avoid the physical layer circuit. This effectively prevents a situation in which a change in the voltage level of the scan output lines is transmitted to the physical layer circuit as signal noise. Therefore, an integrated circuit device can be provided which can prevent a malfunction and the like when incorporating a high-speed interface circuit block.

In the integrated circuit device according to this embodiment, the high-speed interface circuit block and the scan driver block may be disposed along a first direction; and when a direction perpendicular to the first direction is referred to as a second direction, the scan driver pad arrangement region may be provided in the second direction with respect to the high-speed interface circuit block and the scan driver block.

When employing such an arrangement relationship, if the scan output lines are provided without taking signal noise into account, the scan output lines are provided over the physical layer circuit. According to this embodiment, since the scan output lines are provided over the link controller while avoiding the physical layer circuit, a large number of scan output lines from the scan driver block can be provided while reducing an adverse effect of signal noise.

In the integrated circuit device according to this embodiment, the link controller may be disposed in the second direction with respect to the physical layer circuit.

According to this configuration, since the scan output lines can be provided by effectively utilizing the wiring area over the link controller disposed in the second direction with respect to the physical layer circuit, the layout efficiency can be increased.

In the integrated circuit device according to this embodiment, the integrated circuit device may comprise:

a logic circuit block that receives data received by the high-speed interface circuit block and controls the scan driver block;

the high-speed interface circuit block may be disposed between the logic circuit block and the scan driver block.

This prevents a situation in which signal noise from a signal line and the like provided in the third direction with respect to the logic circuit block adversely affects the high-speed interface circuit block, for example.

In the integrated circuit device according to this embodiment, the logic circuit block and the link controller may be integrally formed by automatic placement and routing.

This enables the main logic section of the integrated circuit device (i.e., logic circuit block and link controller) to be formed by one automatic placement and routing, for example, whereby the design efficiency and the work efficiency can be increased.

In the integrated circuit device according to this embodiment, the integrated circuit device may include a shield line provided in the link controller in a lower layer of the plurality of scan output lines of the scan driver block passing over the link controller.

According to this configuration, a situation in which can be prevented in which noise due to a change in the voltage level of the scan output lines is transmitted to circuits and signal lines in the link controller due to capacitive coupling.

According to another embodiment of the invention, there is provided an integrated circuit device comprising:

a common voltage generation circuit that generates a common voltage applied to a common electrode of a display panel;

a high-speed interface circuit block that includes a physical layer circuit and transfers data through a serial bus using differential signals; and first and second common voltage pads that output the common voltage generated by the common voltage generation circuit to the outside;

when a direction from a first side as a short side of the integrated circuit device toward a third side opposite to the first side is referred to as a first direction, a direction from a second side as a long side of the integrated circuit device toward a fourth side opposite to the second side is referred to as a second direction, a direction opposite to the first direction is referred to as a third direction, and a direction opposite to the second direction is referred to as a fourth direction, the first common voltage pad being disposed in the third direction with respect to the data driver block, and the second common voltage pad being disposed in the first direction with respect to the data driver block;

first and second differential input pads to which first and second signals forming the differential signals are input from the outside being disposed in the fourth direction with respect to the physical layer circuit; and a common voltage line connecting the first and second common voltage pads being provided from the first common voltage pad to the second common voltage pad along the first direction, the common voltage line being provided in the second direction with respect to the physical layer circuit along the first direction in an arrangement region of the physical layer circuit.

According to this embodiment, the first and second common voltage pads are connected through the common voltage line. Therefore, deterioration in display quality due to the imbalanced parasitic resistance of the common voltage line can be reduced. The common voltage line is provided in the second direction with respect to the physical layer circuit along the first direction. Therefore, noise from the common voltage line can be prevented from being superimposed on the differential signals of the physical layer circuit, whereby a malfunction of the high-speed interface circuit due to noise can be prevented.

In the integrated circuit device according to this embodiment, the common voltage line may be provided in the fourth direction with respect to the data driver block along the first direction in an arrangement region of the data driver block.

According to this configuration, since the data signal line from the data driver block does not intersect the common voltage line, a situation in which the display quality deteriorates due to a change in the level of the common voltage caused by noise from the data signal line can be prevented.

In the integrated circuit device according to this embodiment, the high-speed interface circuit block may include a link controller that is disposed in the second direction with respect to the physical layer circuit and performs a link layer process; and the common voltage line may be provided in the second direction with respect to the link controller along the first direction.

This prevents a situation in which noise from the signal line between the physical layer circuit and the link controller is transmitted to the common voltage line.

In the integrated circuit device according to this embodiment, the common voltage generation circuit may be disposed in the third direction with respect to the data driver block.

In the integrated circuit device according to this embodiment, the integrated circuit device may include a first shield line formed of an interconnect layer in a layer differing from the common voltage line and provided with a given power supply potential, the first shield line being provided to overlap the common voltage line.

This enables noise from the upper side or the lower side of the common voltage line to be effectively shielded using the first shield line.

In the integrated circuit device according to this embodiment, the integrated circuit device may include second shield lines formed of an interconnect layer in the same layer as the common voltage line and provided with a given power supply potential, the second shield lines being provided on either side of the common voltage line.

This enables noise from each side of the common voltage line to be effectively shielded using the second shield lines.

In the integrated circuit device according to this embodiment, the integrated circuit device may comprise:

first to Nth circuit blocks (N is an integer equal to or larger than two) disposed along a first direction, the first to Nth circuit blocks including:

at least one data driver block that drives a plurality of data lines of the display panel;

a grayscale voltage generation circuit block that generates grayscale voltages; and a logic circuit block that receives data received by the high-speed interface circuit block and transfers grayscale adjustment data for adjusting the grayscale voltages to the grayscale voltage generation circuit block;

when a direction perpendicular to the first direction is referred to as a second direction, a direction opposite to the first direction is referred to as a third direction, and a direction opposite to the second direction is referred to as a fourth direction, the grayscale voltage generation circuit block may be disposed in the third direction with respect to the data driver block, and the high-speed interface circuit block and the logic circuit block may be disposed in the first direction with respect to the data driver block.

According to this configuration, since the first to Nth circuit blocks are disposed along the first direction, the width of the integrated circuit device in the second direction can be reduced, whereby a reduction in area can be achieved. Moreover, interconnects can be provided utilizing the free space in the second direction with respect to the grayscale voltage generation circuit block and the logic circuit block, whereby the wiring efficiency can be increased. Furthermore, since the data driver block can be disposed near the center of the integrated circuit device, data signal output lines from the data driver block can be efficiently and simply provided.

In the integrated circuit device according to this embodiment, the integrated circuit device may include:

local lines provided between adjacent circuit blocks among the first to Nth circuit blocks, the local lines being formed of an interconnect layer lower than an Ith (I is an integer equal to or larger than three) layer;

global lines provided between nonadjacent circuit blocks among the first to Nth circuit blocks, the global lines being formed of an interconnect layer in a layer equal to or higher than the Ith layer to pass over a circuit block disposed between the nonadjacent circuit blocks along the first direction; and grayscale global lines that supplies the grayscale voltages from the grayscale voltage generation circuit block to the data driver, the grayscale global lines being provided over the data driver block along the first direction.

This allows the adjacent circuit blocks to be connected along a short path using the local lines, whereby an increase in chip area due to the wiring region can be prevented. Moreover, since the global lines are provided between the nonadjacent circuit blocks, the grayscale global line can be provided over the local lines, even if the number of local lines is large.

In the integrated circuit device according to this embodiment, the integrated circuit device may comprise:

first to Nth circuit blocks (N is an integer equal to or larger than two) disposed along a first direction, the first to Nth circuit blocks including:

at least one data driver block that drives a plurality of data lines of the display panel;

a power supply circuit block that generates a power supply voltage; and a logic circuit block that receives data received by the high-speed interface circuit block and transfers power supply adjustment data for adjusting the power supply voltage to the power supply circuit block;

when a direction perpendicular to the first direction is referred to as a second direction, a direction opposite to the first direction is referred to as a third direction, and a direction opposite to the second direction is referred to as a fourth direction, the power supply circuit block may be disposed in the third direction with respect to the data driver block, and the high-speed interface circuit block and the logic circuit block may be disposed in the first direction with respect to the data driver block.

According to this configuration, interconnects can be provided utilizing the free space in the second direction with respect to the power supply circuit block and the logic circuit block, whereby the wiring efficiency can be increased.

In the integrated circuit device according to this embodiment, the integrated circuit device may include:

local lines provided between adjacent circuit blocks among the first to Nth circuit blocks, the local lines being formed of an interconnect layer lower than an Ith (I is an integer equal to or larger than three) layer;

global lines provided between nonadjacent circuit blocks among the first to Nth circuit blocks, the global lines being formed of an interconnect layer in a layer equal to or higher than the Ith layer to pass over a circuit block disposed between the nonadjacent circuit blocks along the first direction; and a power supply global line that supplies the power supply voltage from the power supply circuit block, the power supply global line being provided over the data driver block along the first direction.

According to this configuration, since the global lines are provided between the nonadjacent circuit blocks, the power supply global line can be provided over the local lines, even if the number of local lines is large, whereby the wiring efficiency can be increased.

In the integrated circuit device according to this embodiment, the integrated circuit device may comprise:

first to Nth circuit blocks (N is an integer equal to or larger than two) disposed along the first direction, the first to Nth circuit blocks including:

the data driver block;

a grayscale voltage generation circuit block that generates grayscale voltages; and a logic circuit block that receives data received by the high-speed interface circuit block and transfers grayscale adjustment data for adjusting the grayscale voltages to the grayscale voltage generation circuit block;

the grayscale voltage generation circuit block may be disposed in the third direction with respect to the data driver block, and the high-speed interface circuit block and the logic circuit block may be disposed in the first direction with respect to the data driver block.

According to this configuration, since the first to Nth circuit blocks are disposed along the first direction, the width of the integrated circuit device in the second direction can be reduced, whereby a reduction in area can be achieved. Moreover, interconnects can be provided utilizing the free space in the second direction with respect to the grayscale voltage generation circuit block and the logic circuit block, whereby the wiring efficiency can be increased. Furthermore, since the data driver block can be disposed near the center of the integrated circuit device, data signal output lines from the data driver block can be efficiently and simply provided.

The integrated circuit device according to this embodiment may include: local lines provided between adjacent circuit blocks among the first to Nth circuit blocks, the local lines being formed of an interconnect layer lower than an Ith (I is an integer equal to or larger than three) layer; global lines provided between nonadjacent circuit blocks among the first to Nth circuit blocks, the global lines being formed of an interconnect layer in a layer equal to or higher than the Ith layer to pass over a circuit block disposed between the nonadjacent circuit blocks along the first direction; and a grayscale global line that supplies the grayscale voltage from the grayscale voltage generation circuit block to the data driver, the grayscale global line being provided over the data driver block along the first direction.

This allows the adjacent circuit blocks to be connected through the local lines along a short path, whereby an increase in chip area due to an increase in wiring region can be prevented. Moreover, since the global lines are provided between the nonadjacent circuit blocks, the grayscale global line can be provided over the local lines, even if the number of local lines is large.

In the integrated circuit device according to this embodiment, the logic circuit block may transfer the grayscale adjustment data to the grayscale voltage generation circuit block by time division through n-bit (n is a positive integer) grayscale transfer lines, and the grayscale transfer lines may be provided over the data driver block along the first direction using the global lines.

According to this configuration, since the grayscale adjustment data can be transferred through the grayscale transfer lines by time division in units of n bits, the number of grayscale transfer lines can be reduced.

In the integrated circuit device according to this embodiment, the first to Nth circuit blocks may include first and second scan driver blocks that drive the scan lines, the grayscale voltage generation circuit block may be disposed between the first scan driver block and the data driver block, and the high-speed interface circuit block may be disposed between the second scan driver block and the data driver block.

In the integrated circuit device according to this embodiment, the integrated circuit device may comprise:

first to Nth circuit blocks (N is an integer equal to or larger than two) disposed along the first direction, the first to Nth circuit blocks including:

the data driver block;

a power supply circuit block that generates a power supply voltage; and a logic circuit block that receives data received by the high-speed interface circuit block and transfers power supply adjustment data for adjusting the power supply voltage to the power supply circuit block;

the power supply circuit block may be disposed in the third direction with respect to the data driver block, and the high-speed interface circuit block and the logic circuit block may be disposed in the first direction with respect to the data driver block.

According to this configuration, interconnects can be provided utilizing the free space in the second direction with respect to the power supply circuit block and the logic circuit block, whereby the wiring efficiency can be increased.

The integrated circuit device according to this embodiment may include: local lines provided between adjacent circuit blocks among the first to Nth circuit blocks, the local lines being formed of an interconnect layer lower than an Ith (I is an integer equal to or larger than three) layer; global lines provided between nonadjacent circuit blocks among the first to Nth circuit blocks, the global lines being formed of an interconnect layer in a layer equal to or higher than the Ith layer to pass over a circuit block disposed between the nonadjacent circuit blocks along the first direction; and a power supply global line that supplies the power supply voltage from the power supply circuit block, the power supply global line being provided over the data driver block along the first direction.

According to this configuration, since the global lines are provided between the nonadjacent circuit blocks, the power supply global line can be provided over the local lines, even if the number of local lines is large, whereby the wiring efficiency can be increased.

In the integrated circuit device according to this embodiment, the logic circuit block may transfer the power supply adjustment data to the power supply circuit block by time division through m-bit (m is a positive integer) power supply transfer lines, and the power supply transfer lines may be provided over the data driver block along the first direction using the global lines.

According to this configuration, since the power supply adjustment data can be transferred through the power supply transfer lines by time division in units of m bits, the number of power supply transfer lines can be reduced.

In the integrated circuit device according to this embodiment, the first to Nth circuit blocks may include first and second scan driver blocks that drive the scan lines, the power supply circuit block may be disposed between the first scan driver block and the data driver block, and the high-speed interface circuit block may be disposed between the second scan driver block and the data driver block.

According to a further embodiment of the invention, there is provided an electronic instrument comprising:

one of the above integrated circuit devices; and a display panel driven by the integrated circuit device.

Preferred embodiments of the invention are described below in detail. Note that the embodiments described below do not in any way limit the scope of the invention defined by the claims laid out herein. Note that all elements of the embodiments described below should not necessarily be taken as essential requirements for the invention.

1. Routing of Scan Output Line of Scan Driver Block

In recent years, a high-speed I/F circuit (high-speed interface circuit) which serially transfers data using differential signals has attracted attention. Since the high-speed I/F circuit handles small-amplitude differential signals, the high-speed I/F circuit tends to be affected by noise, whereby a malfunction such as a data transfer error may occur due to noise. Therefore, it is desirable to minimize the effect of noise on the high-speed I/F circuit. When providing a scan driver (gate driver) in an integrated circuit device such as a display driver, the amplitude of the output signal of the scan driver is about 10 to 20 V, for example, which is much larger than the amplitude of the differential signals. Therefore, the high-speed I/F circuit may malfunction due to noise from the output signal of the scan driver when no measures are taken.

FIG. 1 shows an arrangement configuration example of an integrated circuit device 10 according to this embodiment. As shown in FIG. 1, the integrated circuit device 10 includes at least one scan driver block SB which drives scan lines of a display panel, and a high-speed I/F circuit block HB which transfers data through a serial bus using differential signals. The high-speed I/F circuit block HB includes a physical layer circuit PHY and a link controller LKC. The integrated circuit device 10 also includes a scan driver pad arrangement region PR in which pads electrically connecting scan output lines (i.e., output lines of the scan driver block SB) and the scan lines are disposed.

The scan driver block SB outputs a scan signal (gate signal) with an amplitude of about 10 to 20 V as a select signal of the scan line of the display panel. The scan signals are input to the pads provided in the scan driver pad arrangement region PR through the scan output lines indicated by H1. The scan signals are output to the scan lines (gate lines) of the external display panel through the pads.

The physical layer circuit PHY included in the high-speed I/F circuit block HB is a circuit which transfers data through a serial bus using differential signals. For example, the physical layer circuit PHY receives data (packet) using differential signals. Specifically, the physical layer circuit PHY may include a receiver circuit to which first and second signals forming small-amplitude differential signals are input. The physical layer circuit PHY may include a serial/parallel conversion circuit which converts serial data received through the serial bus into parallel data. The physical layer circuit PHY may include a transmitter circuit which transmits data using differential signals, and a parallel/serial conversion circuit which converts parallel data into serial data.

The link controller LKC included in the high-speed I/F circuit block HB performs a link layer process such as processing a packet. Specifically, the link controller LKC analyzes a packet received through the physical layer circuit PHY. Or, the link controller LKC may generate a packet transmitted through the physical layer circuit PHY. The link controller LKC may detect a communication error or control a transfer sequence at the link layer level.

In FIG. 1, the scan output lines of the scan driver block SB are provided from the scan driver block SB to the scan driver pad arrangement region PR while avoiding the physical layer circuit PHY, as indicated by H1. Specifically, the scan output lines are provided to reach the scan driver pad arrangement region PR while passing over the link controller LKC without passing over the physical layer circuit PHY.

Figure 2:
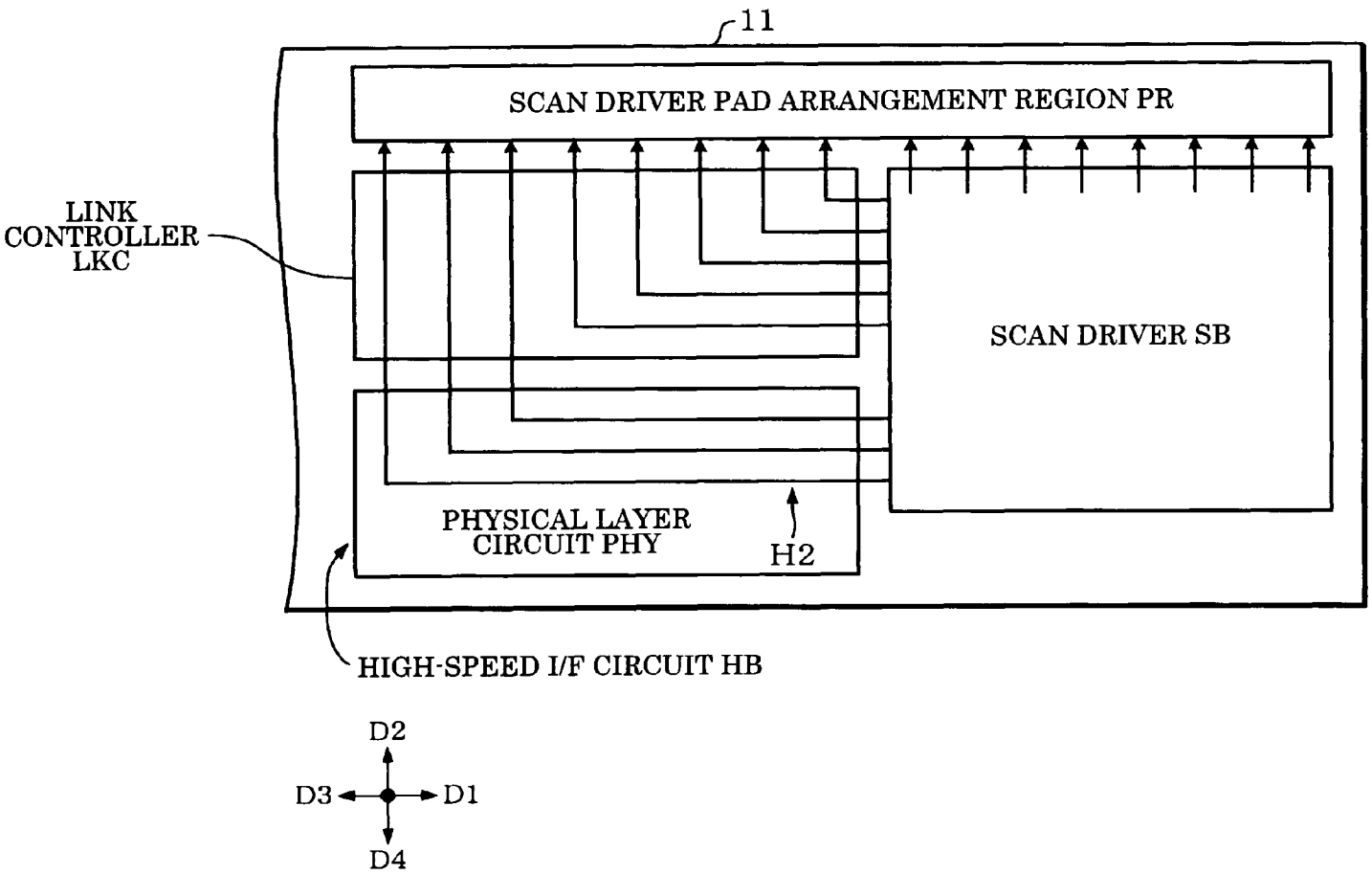
FIG. 2 shows an arrangement configuration example of an integrated circuit device according to a comparative example.

FIG. 2 shows the arrangement configuration according to a comparative example. In the comparative example shown in FIG. 2, the scan output lines of the scan driver block SB are provided over the physical layer circuit PHY. The amplitude of the scan signal transmitted through the scan output line is as large as about 10 to 20 V, as described above. Therefore, when the voltage level of the scan output line has changed, the change in the voltage level of the scan output line is transmitted to the physical layer circuit PHY as signal noise through a parasitic capacitor formed of an insulating film or the like. As a result, the physical layer circuit PHY (e.g., receiver circuit) may malfunction, whereby a data transfer error or the like may occur.

According to the embodiment shown in FIG. 1, the scan output lines of the scan driver block SB are provided to avoid the physical layer circuit PHY. This prevents a situation in which a change in the voltage level of the scan output line is transmitted to the physical layer circuit PHY as signal noise.

In FIG. 1, the high-speed I/F circuit block HB and the scan driver block SB are disposed along a first direction D1. Specifically, the high-speed I/F circuit block HB and the scan driver block SB are adjacently disposed along the first direction D1. When a direction perpendicular to the direction D1 is referred to as a second direction D2, the scan driver pad arrangement region PR is provided in the direction D2 with respect to the high-speed I/F circuit block HB and the scan driver block SB. In FIG. 1, a direction opposite to the direction D1 is a third direction D3, and a direction opposite to the direction D2 is a fourth direction D4.

According to the arrangement relationship shown in FIG. 1, since the scan driver block SB is disposed on the end of the integrated circuit device 10, the high-speed I/F circuit block HB need not be disposed on the end of the integrated circuit device 10.

However, according to the arrangement relationship shown in FIG. 1, a large number of scan output lines from the scan driver block SB must be provided to reach the scan driver pad arrangement region PR disposed in the direction D2 with respect to the scan driver block SB. Specifically, in order to prevent the scan output lines from intersecting, it is necessary to provide the scan output lines along the direction D1 and then turn the scan output lines toward the direction D2 to reach the scan driver pad arrangement region PR. Therefore, if the scan output lines are provided without taking signal noise into account, the scan output lines are provided over the physical layer circuit PHY as in the comparative example shown in FIG. 2.

According to this embodiment, even if the scan driver block SB, the high-speed I/F circuit block HB, and the scan driver pad arrangement region PR have the arrangement relationship shown in FIG. 1, the scan output lines are not provided over the physical layer circuit PHY by effectively providing the scan output lines. Therefore, a large number of scan output lines from the scan driver block SB can be efficiently provided while reducing an adverse effect of signal noise.

In FIG. 1, the link controller LKC is disposed in the direction D2 with respect to the physical layer circuit PHY. Specifically, the physical layer circuit PHY and the link controller LKC are adjacently disposed along the direction D2. This arrangement enables the physical layer circuit PHY and the link controller LKC to be connected through a signal line along a short path, whereby the layout efficiency can be increased. In particular, since the operating frequency of the signal line between the physical layer circuit PHY and the link controller LKC is high, a signal transmission error can be prevented by providing the signal line along a short path.

In FIG. 1, the scan output lines from the scan driver block SB are provided over the physical layer circuit PHY, focusing on the presence of the link controller LKC disposed in the direction D2 with respect to the physical layer circuit PHY. The layout efficiency can be increased by providing the scan output lines while effectively utilizing the wiring area over the link controller LKC, thereby preventing a situation in which the width of the integrated circuit device 10 in the direction D2 increases due to the wiring area of the scan output lines. Therefore, the chip area can be reduced by increasing the layout efficiency while reducing an adverse effect of signal noise.

2. Relationship with Logic Circuit Block

Figure 3A:
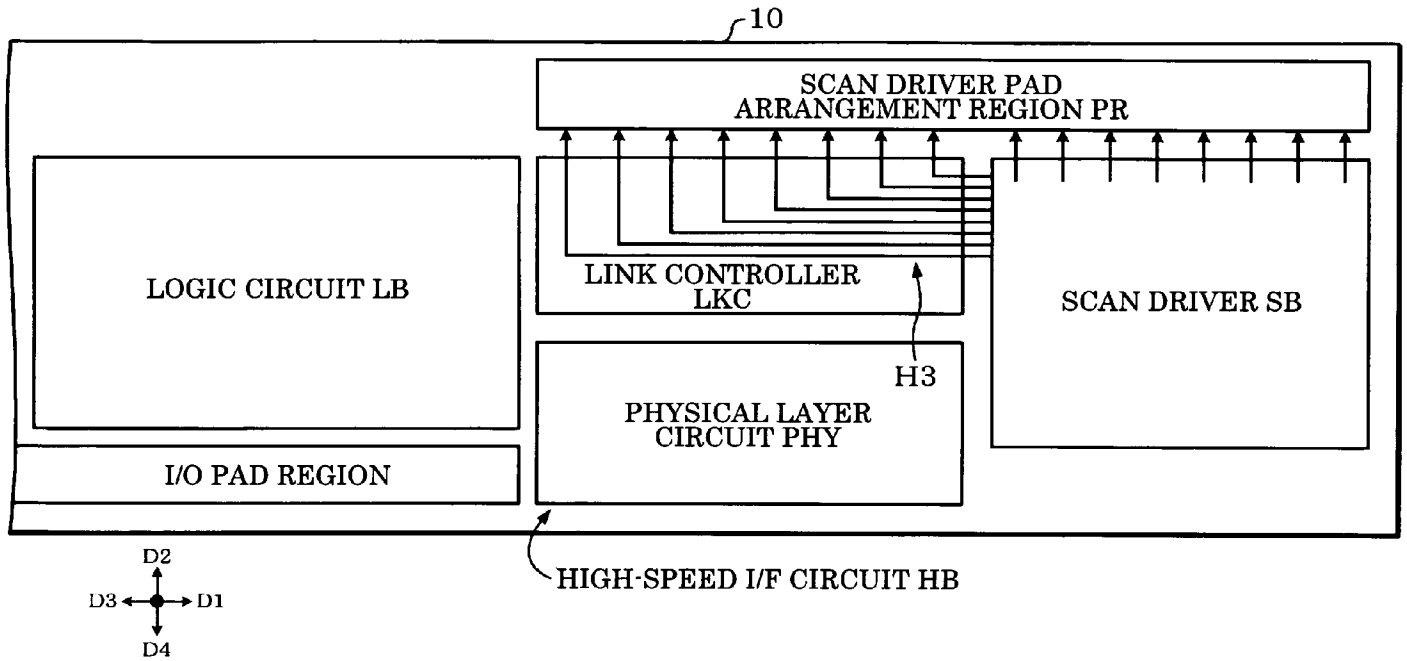
FIGS. 3A and 3B show a detailed arrangement configuration example of an integrated circuit device.

FIG. 3A shows a detailed arrangement configuration example of the integrated circuit device 10. In FIG. 3A, the integrated circuit device 10 further includes a logic circuit block LB.

The logic circuit block LB receives data received by the high-speed I/F circuit block HB. Specifically, the logic circuit block LB receives data received by the physical layer circuit PHY using differential signals and extracted (analyzed) by a packet analysis circuit of the link controller LKC. The logic circuit block LB controls the scan driver block SB. Specifically, the logic circuit block LB controls various timings such as the scan line scan start timing of the scan driver block SB. The logic circuit block LB also controls the high-speed I/F circuit block HB and a data driver block described later. The logic circuit block LB may be formed by automatic placement and routing using a gate array (G/A) or the like.

In FIG. 3A, the high-speed I/F circuit block HB is disposed between the logic circuit block LB and the scan driver block SB. Specifically, the logic circuit block LB and the high-speed I/F circuit block HB are adjacently disposed along the direction D1, and the high-speed I/F circuit block HB and the scan driver block SB are also adjacently disposed along the direction D1.

According to the arrangement shown in FIG. 3A, the high-speed I/F circuit block HB (link controller LKC) and the logic circuit block LB can be connected through a signal line along a short path. Therefore, the layout efficiency can be increased while reducing a signal skew between the high-speed I/F circuit block HB and the logic circuit block LB.

A large number of I/O signal lines from an IO pad region are provided in the logic circuit block LB along the direction D1. The data driver blocks are disposed in the direction D3 with respect to the logic circuit block LB, as described later, and a large number of global lines are provided over the data driver blocks along the direction D1. Specifically, a large number of signal lines such as the global lines and the I/O signal lines are provided in the direction D3 with respect to the logic circuit block LB. Therefore, if the high-speed I/F circuit block HB is disposed in the direction D3 with respect to the logic circuit block LB, the high-speed I/F circuit block HB may malfunction due to noise from these signal lines.

In FIG. 3A, since the high-speed I/F circuit block HB is disposed in the direction D1 with respect to the logic circuit block LB, a malfunction due to noise from the signal line such as the global line can be prevented. Since the scan driver block SB is disposed in the direction D1 with respect to the high-speed I/F circuit block HB, the high-speed I/F circuit block HB is not disposed on the end (right end) of the integrated circuit device 10. Therefore, an increase in contact resistance of pads or the like, which occurs when disposing the high-speed I/F circuit block HB on the end of the integrated circuit device 10, can be prevented, whereby deterioration in signal quality of high-speed serial transfer can be prevented.

When disposing the high-speed I/F circuit block HB between the logic circuit block LB and the scan driver block SB, noise from the scan output line may be transmitted to the physical layer circuit PHY, whereby a malfunction or the like may occur. In FIG. 3A, since the scan output lines are provided as indicated by H3, such a situation can be prevented.

Figure 3B:
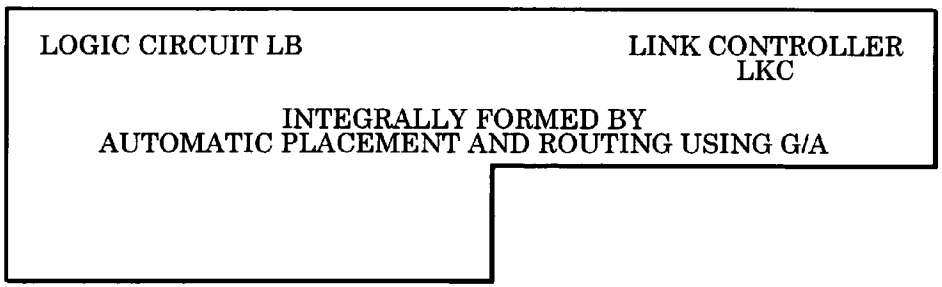

When the logic circuit block LB and the link controller LKC are adjacently disposed along the direction D1, as shown in FIG. 3A, it is desirable to integrally form the logic circuit block LB and the link controller LKC by automatic placement and routing, as shown in FIG. 3B. Specifically, one net list is created by integrating the net list of the logic circuit block LB and the net list of the link controller LKC, for example. Automatic placement and routing of a circuit block in which the logic circuit block LB and the link controller LKC are integrated is performed using the created net list and a known automatic placement and routing tool. Specifically, automatic placement and routing is performed using a gate array (G/A) method utilizing base cells.

This enables the main logic section of the integrated circuit device 10 to be formed by one automatic placement and routing, for example, whereby the design efficiency and the work efficiency can be increased. Moreover, a signal skew and a jitter between the logic circuit block LB and the link controller LKC are optimally reduced by the above integral automatic placement and routing.

Figure 4:
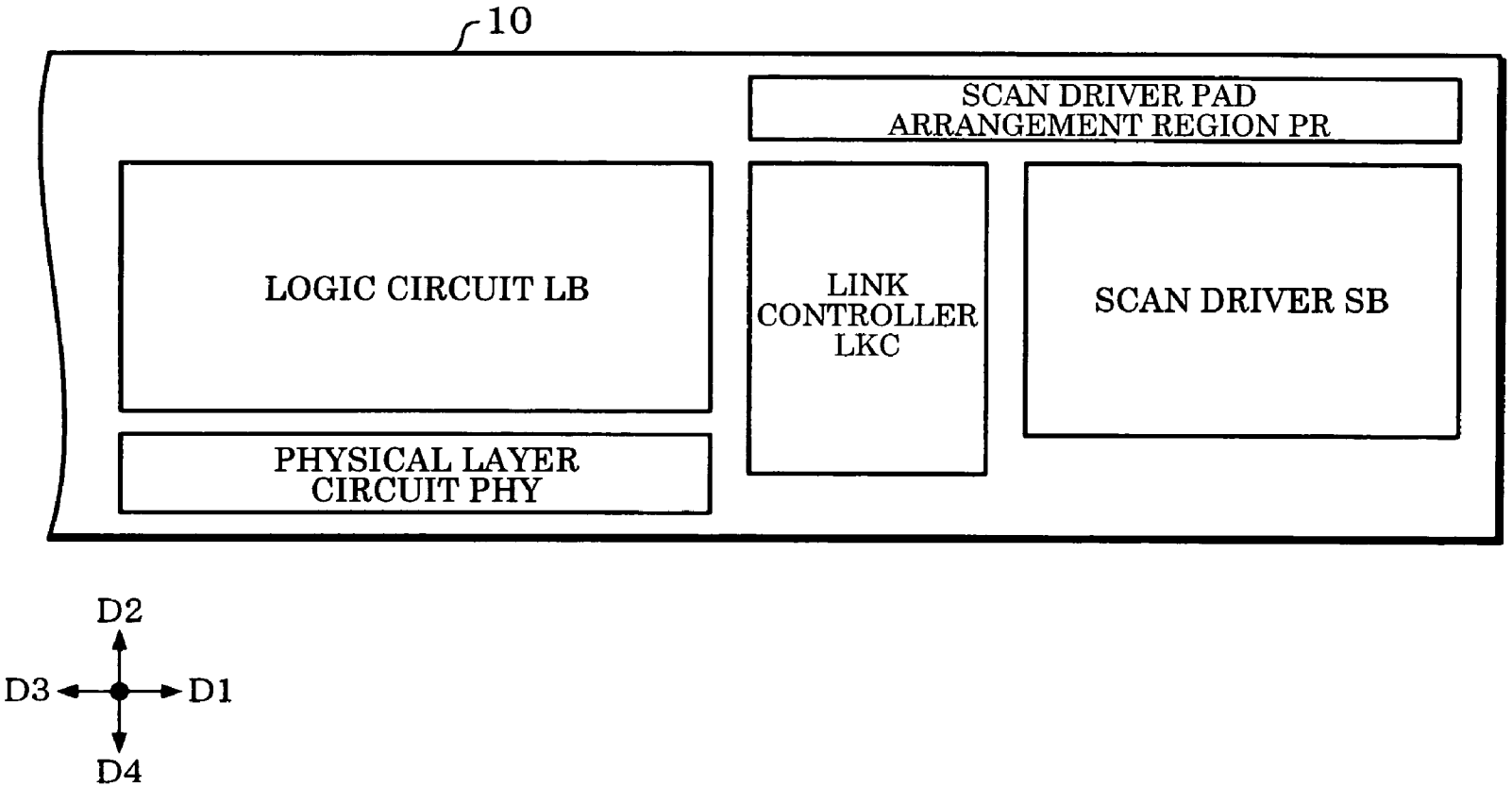
FIG. 4 shows another arrangement configuration example according to one embodiment of the invention.

The arrangement configuration of the logic circuit block LB, the physical layer circuit PHY, the link controller LKC, and the scan driver block SB is not limited to that shown in FIG. 3A. Various modifications and variations may be made. For example, the arrangement configuration shown in FIG. 4 may be employed. In FIG. 4, at least the physical layer circuit PHY of the high-speed I/F circuit block is disposed in the direction D4 with respect to the logic circuit block LB (or data driver block). Specifically, the receiver circuit (or transmitter circuit) of the physical layer circuit PHY is disposed in the direction D4 with respect to the logic circuit block LB (or data driver block), for example. For example, the receiver circuit is disposed in the I/O region provided in the direction D4 with respect to the logic circuit block LB. This enables the length of the integrated circuit device in the direction D1 to be reduced, whereby the chip area can be reduced.

In the link controller LKC, shield lines may be provided in the lower layer of the scan output lines of the scan driver block SB passing over the link controller LKC. For example, shield lines formed using a metal layer in the lower layer of a metal layer forming the scan output lines are provided.

Figure 5:
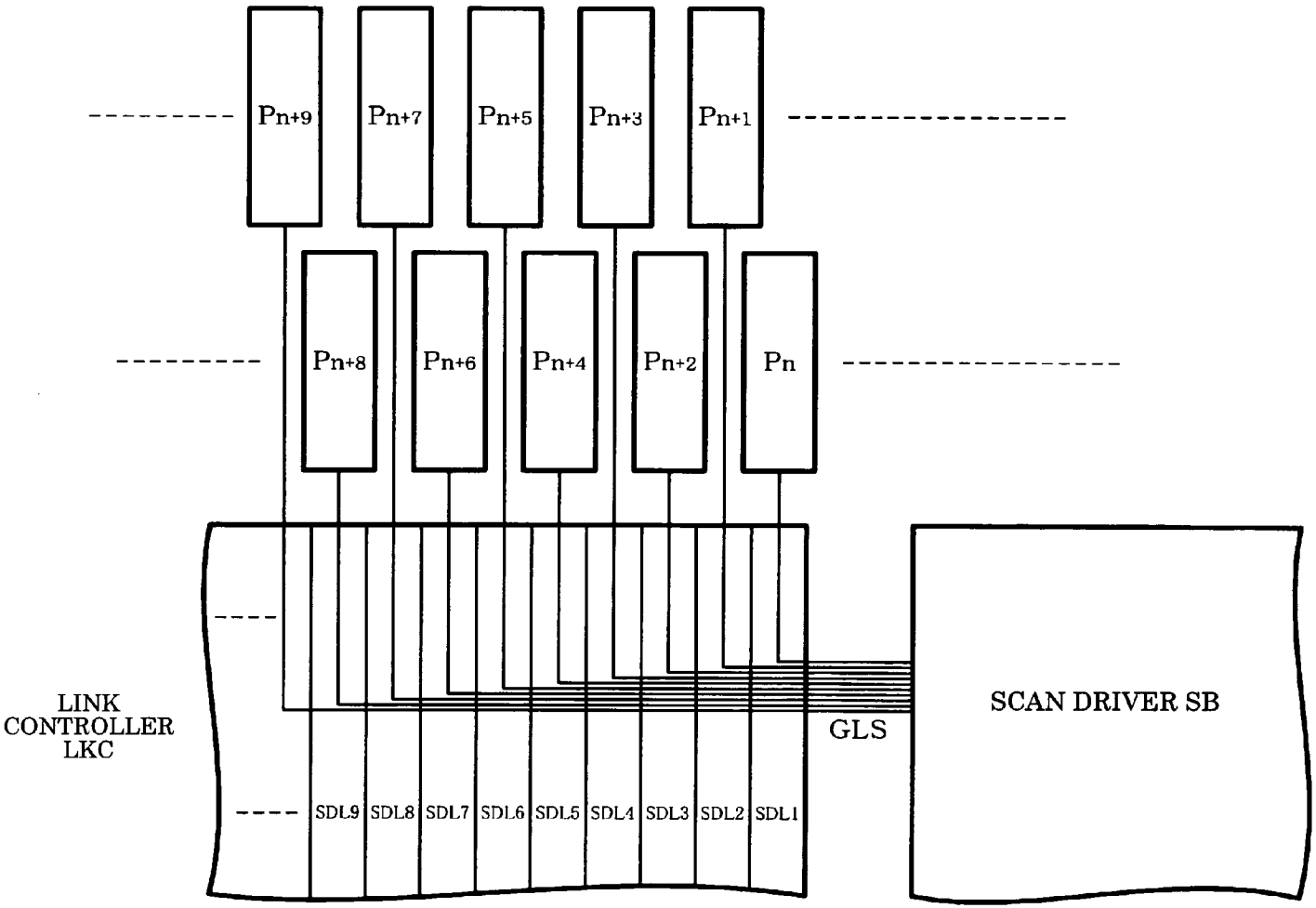
FIG. 5 is a view illustrative of a scan output line shielding method.

FIG. 5 shows a layout example of the shield lines. In FIG. 5, scan output lines (scan driver global lines) GLS from the scan driver block SB pass over the link controller LKC and are connected to scan driver pads Pn, Pn+1, Pn+2, . . . . In the link controller LKC, shield lines SDL1, SDL2, SDL3, . . . are provided in the lower layer of the scan output lines GLS. A situation in which noise due to a change in the voltage level of the scan output lines GLS is transmitted to circuits and signal lines in the link controller LKC due to capacitive coupling can be prevented by providing such shield lines. This prevents a malfunction of these circuits.

3. Common Voltage Line

Figure 6A:
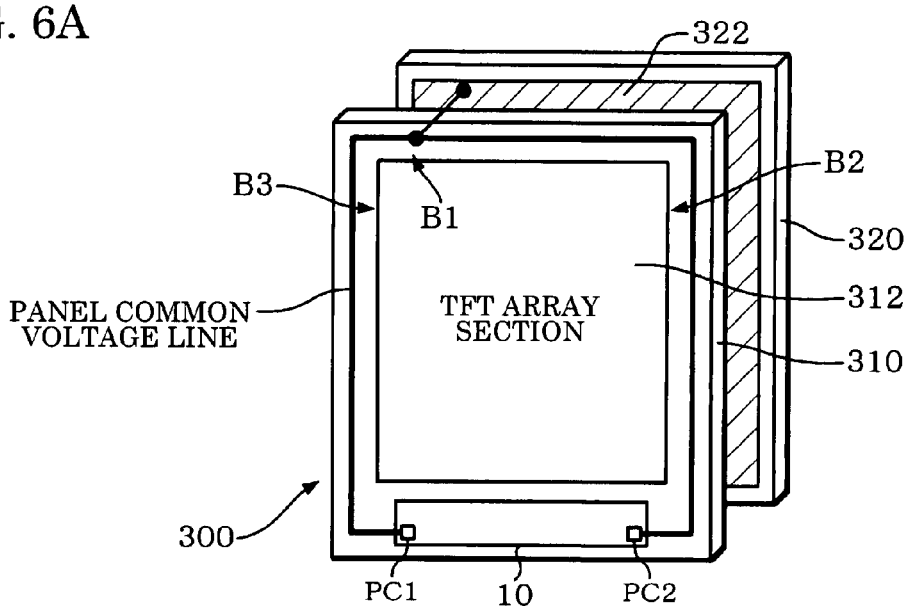
FIGS. 6A to 6C are views illustrative of a display panel.
Figure 6B:
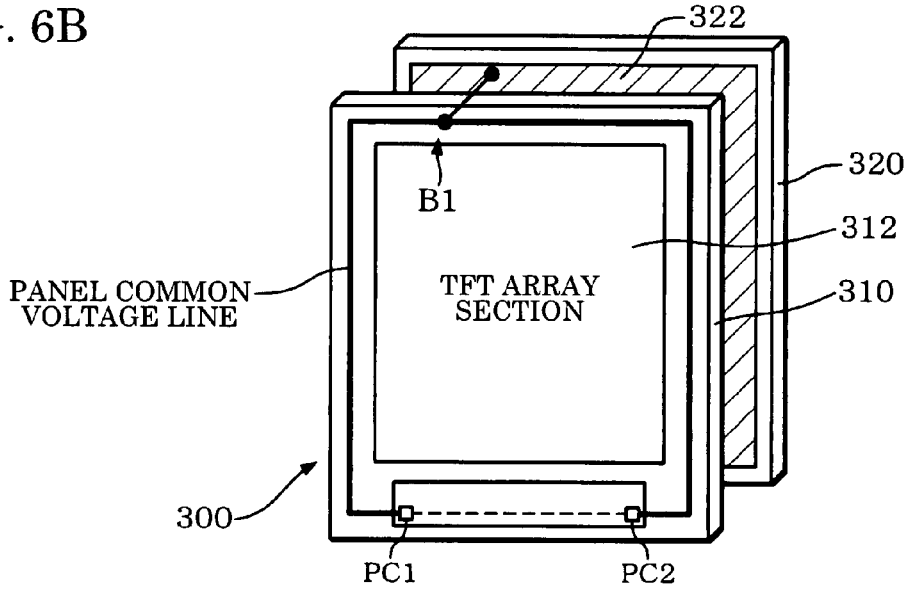

FIGS. 6A and 6B show an example of a display panel 300 on which the integrated circuit device 10 (display driver) according to this embodiment is mounted. The display panel 300 includes an array substrate 310 (array glass substrate) and a common substrate 320 (common glass substrate). A TFT array section 312 in which TFTs and pixel electrodes are disposed in a matrix is formed on the array substrate 310. The common electrode 322 is formed on the common substrate 320. A liquid crystal is sealed between the array substrate 310 and the common substrate 320. The integrated circuit device 10 is mounted on the array substrate 310 by chip-on-glass (COG) technology using bumps (gold bumps or resin core bumps), for example.

In FIGS. 6A and 6B, a panel common voltage line (common voltage line) for supplying a common voltage (common electrode voltage) is provided along the periphery of the TFT array section 312 of the array substrate 310. Specifically, the panel common voltage line is provided from a common voltage pad PC1 provided on the left end of the integrated circuit device 10 (IC) along the left edge, the upper edge, and the right edge of the array substrate 310, and is connected to a common voltage pad PC2 provided on the right end of the integrated circuit device 10. The panel common voltage line is electrically connected with the common electrode 322 of the common substrate 320 at an arbitrary position, such as a position indicated by B1. This enables the common voltage to be supplied to the common electrode 322.

In FIG. 6A, the panel common voltage line is not provided under the integrated circuit device 10. In FIG. 6B, the panel common voltage line is provided under the integrated circuit device 10.

Figure 6C:
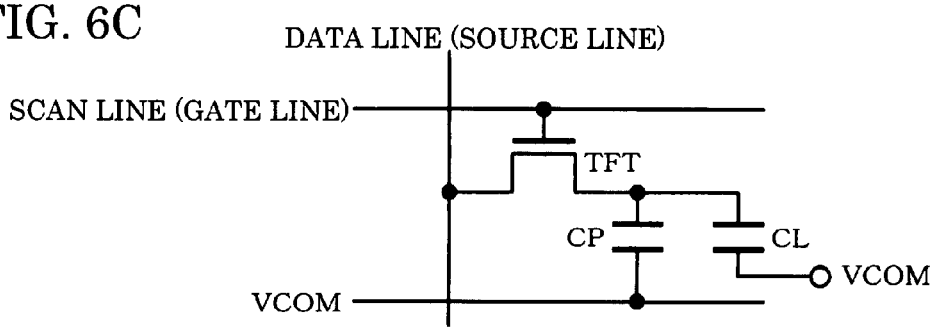

As shown in FIG. 6C, a data line (source line) is connected with the source of a TFT (thin film transistor), and a scan line (gate line) is connected with the gate of the TFT. The integrated circuit device 10 supplies a data signal and a scan signal to the data line and the scan line, respectively. One end of a liquid crystal capacitor CL formed of a liquid crystal element is connected with the drain of the TFT, and a common voltage is supplied to the other end of the liquid crystal capacitor CL. One end of a storage capacitor CP is connected with the drain of the TFT, the common voltage is supplied to the other end of the storage capacitor CP. When using such a storage capacitor CP, the panel common voltage line is also provided in the TFT array section 312 shown in FIGS. 6A and 6B.

Since a liquid crystal element (electro-optical element in a broad sense) deteriorates when a direct-current voltage is applied for a long period of time, a drive method such as frame inversion drive, scan line inversion drive, data line inversion drive, or dot inversion drive is used.

Figure 7:
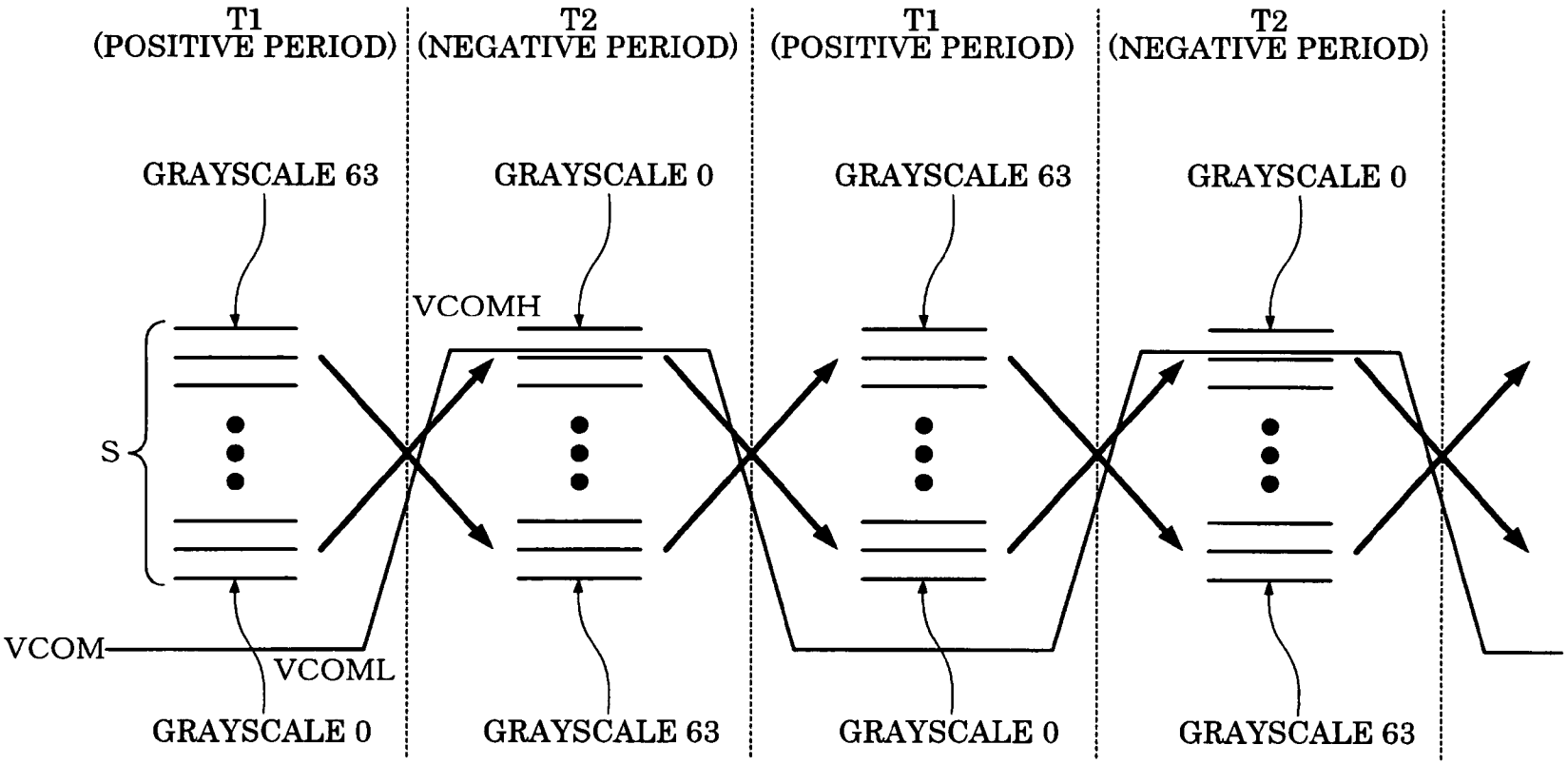
FIG. 7 is a view illustrative of common voltage inversion drive.

Scan line inversion drive is employed in a signal waveform example shown in FIG. 7. In scan line inversion drive, the polarity of the voltage applied to the liquid crystal element is reversed in units of scan periods (horizontal scan periods or scan lines). Therefore, the polarity of the voltage level of the common voltage VCOM applied to the common electrode 322 is also reversed in units of scan periods. As shown in FIG. 7, the voltage level of the common voltage VCOM is set at a low-potential-side voltage VCOML in a positive period T1 (first period) and is set at a high-potential-side voltage VCOMH in a negative period T2 (second period). The polarity of the grayscale voltage applied to the data line is also reversed in synchronization with the polarity inversion timing.

The positive period T1 is a period in which the voltage level of the pixel electrode to which the grayscale voltage is supplied through the data line is higher than the voltage level of the common electrode 322. In the period T1, a positive voltage is applied to the liquid crystal element. The negative period T2 is a period in which the voltage level of the pixel electrode to which the grayscale voltage is supplied through the data line is lower than the voltage level of the common electrode 322. In the period T2, a negative voltage is applied to the liquid crystal element.

As is clear from FIG. 7, the voltage difference between the grayscale voltage and the common voltage VCOM is applied to the liquid crystal element. Therefore, when the common voltage VCOM generated by the display driver does not reach the desired voltage due to parasitic resistance and the like, the voltage applied to the liquid crystal element does not reach the desired voltage, whereby the display quality deteriorates. In order to prevent such deterioration in display quality, it is important to reduce the parasitic resistance of the common voltage line as much as possible.

4. Common Voltage Line of Integrated Circuit Device

The high-speed I/F circuit is easily affected by external noise, as described above. On the other hand, the display quality of the display panel deteriorates when the parasitic resistance of the common voltage line increases. Therefore, it is desirable to employ a layout method described below.

Figure 8A:
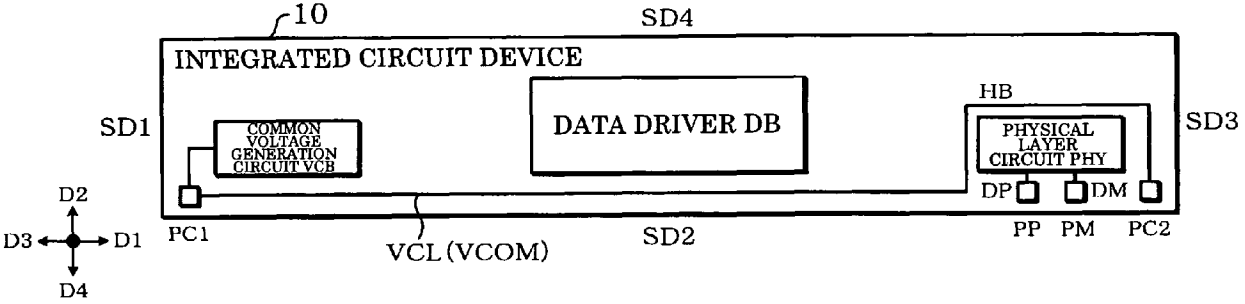
FIGS. 8A to 8C are views illustrative of a common voltage line wiring method.

In FIG. 8A, the integrated circuit device 10 includes a common voltage generation circuit VCB, at least one data driver block DB, and the physical layer circuit PHY forming the high-speed I/F circuit block HB, for example.

In FIG. 8A, the direction from a first side SD1 (short side) of the integrated circuit device 10 toward a third side SD3 opposite to the first side SD1 is referred to as a first direction D1, and the direction opposite to the first direction D1 is referred to as a third direction D3. The direction from a second side SD2 (long side) of the integrated circuit device 10 toward a fourth side SD4 opposite to the second side SD2 is referred to as a second direction D2, and the direction opposite to the second direction D2 is referred to as a fourth direction D4. In FIG. 8A, the left side of the integrated circuit device 10 is the first side SD1, and the right side of the integrated circuit device 10 is the third side SD3. Note that the left side may be the third side SD3 and the right side may be the first side SD1.

The common voltage generation circuit VCB generates the common voltage VCOM applied to the common electrode of the display panel. Specifically, the common voltage generation circuit VCB generates the common voltage VCOM of which the polarity is reversed in units of scan periods, for example.

The data driver block DB is a circuit which drives the data lines of the display panel. In this case, two or more data driver blocks may be provided along the direction D1, for example. A memory block may be provided which is disposed adjacent to the data driver block DB in the direction D1 and stores image data used in the data driver block DB. Or, the memory block may be disposed adjacent to the data driver block DB in the direction D4.

In FIG. 8A, the first and second common voltage pads PC1 and PC2 are provided. The common voltage pad PC1 is disposed in the direction D3 with respect to the data driver block DB, and the common voltage pad PC2 is disposed in the direction D1 with respect to the data driver block DB. Specifically, the common voltage pad PC1 is disposed on the left end of the integrated circuit device 10, and the common voltage pad PC2 is disposed on the right end of the integrated circuit device 10.

First and second differential input pads PP and PM for externally inputting first and second signals DP and DM forming differential signals are disposed in the direction D4 (host side) with respect to the physical layer circuit PHY. A common voltage line VCL (in-chip common voltage line) which connects the common voltage pads PC1 and PC2 is provided from the common voltage pad PC1 to the common voltage pad PC2 along the direction D1. Specifically, the common voltage line VCL is provided in the direction D2 with respect to the physical layer circuit PHY along the direction D1 in the arrangement region of the physical layer circuit PHY. That is, the common voltage line VCL provided from the common voltage pad PC1 in the direction D1 turns along the direction D2 to run around the physical layer circuit PHY so as to avoid the physical layer circuit PHY. The common voltage line VCL is thus provided in the direction D2 with respect to the physical layer circuit PHY along the direction D1, continues in the direction D1, and then turns along the direction D4. The common voltage line VCL is then connected to the common voltage pad PC2.

In FIG. 8A, the common voltage line VCL is provided in the direction D4 with respect to the data driver block DB along the direction D1 in the arrangement region of the data driver block DB. Specifically, the common voltage line VCL is provided along the direction D1 between the host-side side SD2 of the integrated circuit device 10 and the data driver block DB.

Figure 8B:
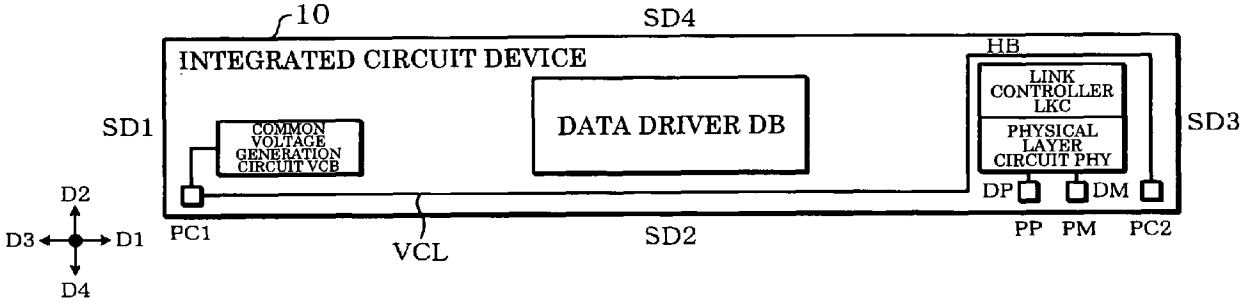

In FIG. 8B, the high-speed I/F circuit block HB includes the link controller LKC which performs a link layer process. The link controller LKC analyzes a packet received using differential signals, for example. Or, the link controller LKC may generate a packet transmitted using differential signals. The link controller LKC is disposed in the direction D2 with respect to the physical layer circuit PHY.

In FIG. 8B, the common voltage line VCL is provided in the direction D2 with respect to the link controller LKC along the direction D1. Specifically, the common voltage line VCL runs along the direction D2 in the direction D3 with respect to the physical layer circuit PHY and the link controller LKC. The common voltage line VCL then turns along the direction D1 in the direction D2 with respect to the link controller LKC, returns along the direction D4 in the direction D1 with respect to the physical layer circuit PHY and the link controller LKC, and is connected to the common voltage pad PC2.

Figure 8C:
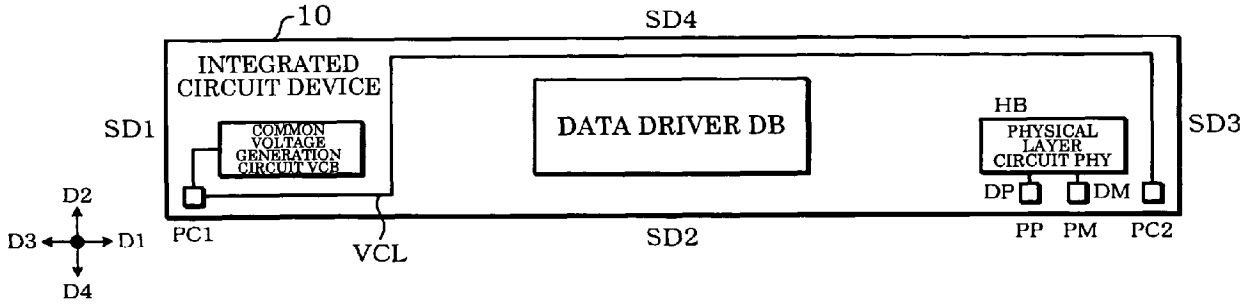

The common voltage generation circuit VCB is disposed in the direction D3 with respect to the data driver block DB. The common voltage generation circuit VCB may be disposed in the direction D1 with respect to the data driver block DB. As shown in FIG. 8C, a modification may be made in which the common voltage line VCL is provided in the direction D2 with respect to the data driver block DB along the direction D1 in the arrangement region of the data driver block DB.

In this embodiment, the common voltage line VCL connects the common voltage pads PC1 and PC2 in the chip of the integrated circuit device 10, as shown in FIGS. 8A to 8C.

For example, if the common voltage pads PC1 and PC2 are not electrically connected in the chip of the integrated circuit device 10 in FIG. 6A, the parasitic resistance of the panel common voltage line at a position indicated by B2 becomes higher than the parasitic resistance of the panel common voltage line at a position indicated by B3 Therefore, the period of time until the common voltage reaches the desired voltage becomes imbalanced due to the imbalanced parasitic resistance, whereby the display quality deteriorates.

According to this embodiment, since the common voltage pads PC1 and PC2 are electrically connected through the common voltage line VCL, the parasitic resistance of the common voltage line at a position indicated by B2 in FIG. 6A can be made almost equal to the parasitic resistance of the common voltage line at a position indicated by B3. Therefore, deterioration in display quality due to the imbalanced parasitic resistance can be reduced. Specifically, even if the panel common voltage line is not provided under the integrated circuit device 10, as shown in FIG. 6A, the common voltage line is provided in the shape of a ring in the peripheral portion of the array substrate 310 in the same manner as in FIG. 6B using the common voltage line VCL provided in the integrated circuit device 10. Therefore, the parasitic resistance can be made equal at each position of the common voltage line. In particular, when providing the panel common voltage line in the TFT array section 312 for the storage capacitor CP, as shown in FIG. 6C, display unevenness or the like may occur if the parasitic resistance of the common voltage line becomes imbalanced. According to this embodiment, occurrence of display unevenness or the like can be prevented by connecting the common voltage pads PC1 and PC2 in the integrated circuit device 10 using the common voltage line VCL.

In this embodiment, the common voltage line VCL is provided to avoid the differential signal lines which connect the physical layer circuit PHY and the differential input pads PP and PM. This prevents a situation in which noise from the common voltage line VCL, of which the voltage changes in units of horizontal scan periods, is superimposed on the input signals DP and the DM of the physical layer circuit PHY, for example. Specifically, if the common voltage line VCL provided from the common voltage pad PC1 along the direction D1 is linearly provided along the direction D1 in the region of the physical layer circuit PHY, the common voltage line VCL intersects the differential signal lines from the differential input pads PP and PM. As a result, noise from the common voltage line VCL is superimposed on the differential signals DP and DM through parasitic capacitors and the like, whereby a data transfer error or the like may occur.

According to this embodiment, since the common voltage line VCL is provided to avoid intersection with the signals DP and DM, such a problem can be prevented.

In FIGS. 8A and 8B, the common voltage line VCL is provided in the direction D4 with respect to the data driver block DB along the direction D1. Therefore, a large number of data signal lines from the data driver block DB do not intersect the common voltage line VCL. This prevents a situation in which noise from a large number of data signal lines is superimposed on the common voltage line VCL through parasitic capacitors. As a result, a situation in which the display quality deteriorates due to a change in the level of the common voltage VCOM can be prevented.

The signal lines which operate at a high speed are provided between the physical layer circuit PHY and the link controller LKC. Therefore, if the common voltage line VCL is provided between the physical layer circuit PHY and the link controller LKC, noise from the high-speed signal lines may be transmitted to the common voltage line VCL, whereby the display quality may deteriorate.

In FIG. 8B, the common voltage line VCL is not provided between the physical layer circuit PHY and the link controller LKC, but is provided in the direction D2 with respect to the link controller LKC. This prevents a situation in which noise from the high-speed signal lines provided between physical layer circuit PHY and the link controller LKC is transmitted to the common voltage line VCL or noise from the common voltage line VCL is transmitted to the high-speed signal lines, whereby the display quality can be increased.

When providing the panel common voltage line under the integrated circuit device 10, as shown in FIG. 6B, it is desirable to provide the panel common voltage line using a method similar to the wiring method for the common voltage line VCL shown in FIGS. 8A to 8C. Specifically, it is desirable to provide the panel common voltage line in the direction D2 with respect to the physical layer circuit PHY and the link controller LKC along the direction D1 so that the panel common voltage line does not intersect the differential signal lines from the differential input pads PP and PM.

Figure 9:
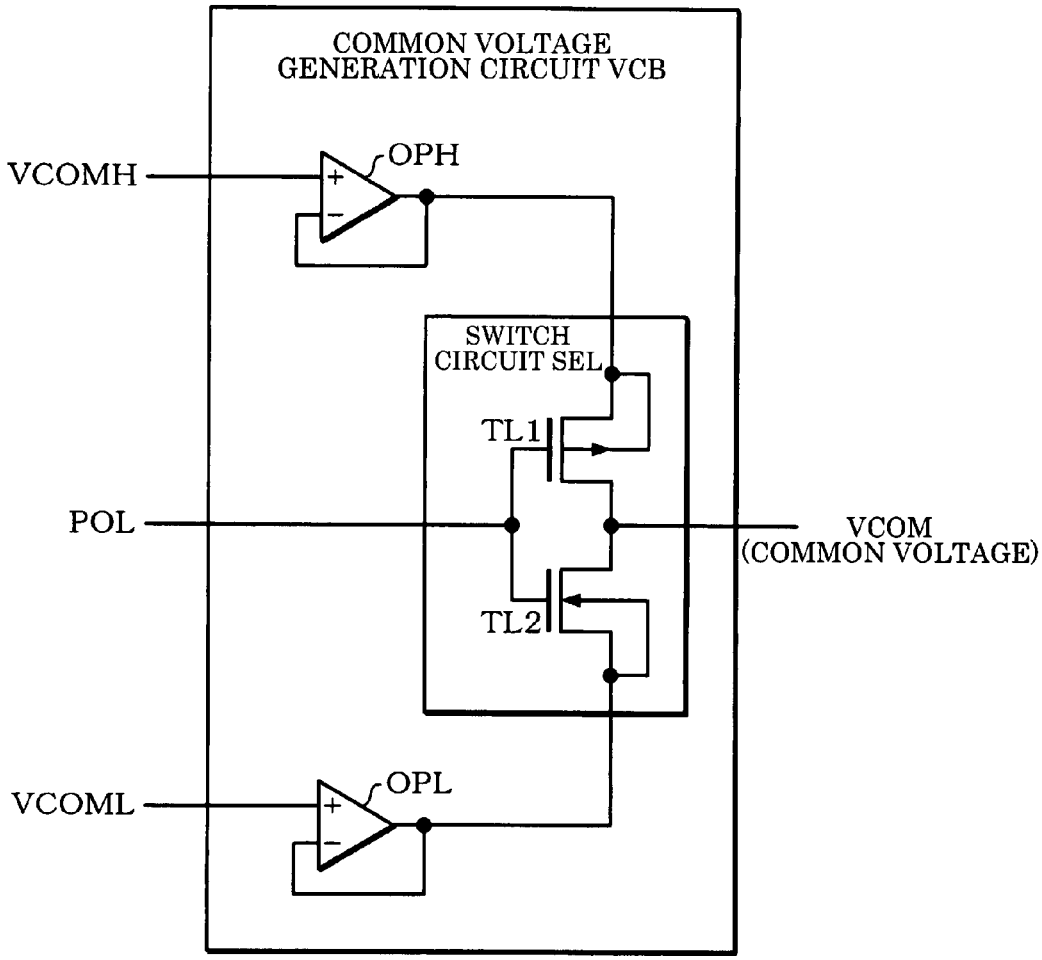
FIG. 9 shows a configuration example of a common voltage generation circuit.

FIG. 9 shows a configuration example of the common voltage generation circuit VCB. The common voltage generation circuit VCB includes voltage-follower-connected operational amplifiers OPH and OPL and a switch circuit SEL. The operational amplifier OPH subjects the high-potential-side voltage VCOMH of the common voltage VCOM to impedance conversion. The operational amplifier OPL subjects the low-potential-side voltage VCOML of the common voltage VCOM to impedance conversion. The switch circuit SEL selects one of the high-potential-side voltage VCOMH and the low-potential-side voltage VCOML from the operational amplifiers OPH and OPL at the polarity inversion timing at which the polarity of the voltage applied to the liquid crystal element (electro-optical material) is reversed, and outputs the selected voltage as the common voltage VCOM.

The switch circuit SEL includes a P-type (first conductivity type) transistor TL1 and an N-type (second conductivity type) transistor TL2. The output of the operational amplifier OPH is connected with the source of the transistor TL1, and a polarity inversion signal POL which specifies the polarity inversion timing is input to the gate of the transistor TL1. The output of the operational amplifier OPL is connected with the source of the transistor TL2, and the polarity inversion signal POL is input to the gate of the transistor TL2. The common voltage VCOM is output to the drains of the transistors TL1 and TL2.

The high-potential-side voltage VCOMH and the low-potential-side voltage VCOML of the common voltage VCOM may be obtained by causing a power supply circuit (not shown) to boost the power supply voltage using a charge pump method, for example.

5. Detailed Layout of Integrated Circuit Device

Figure 10:
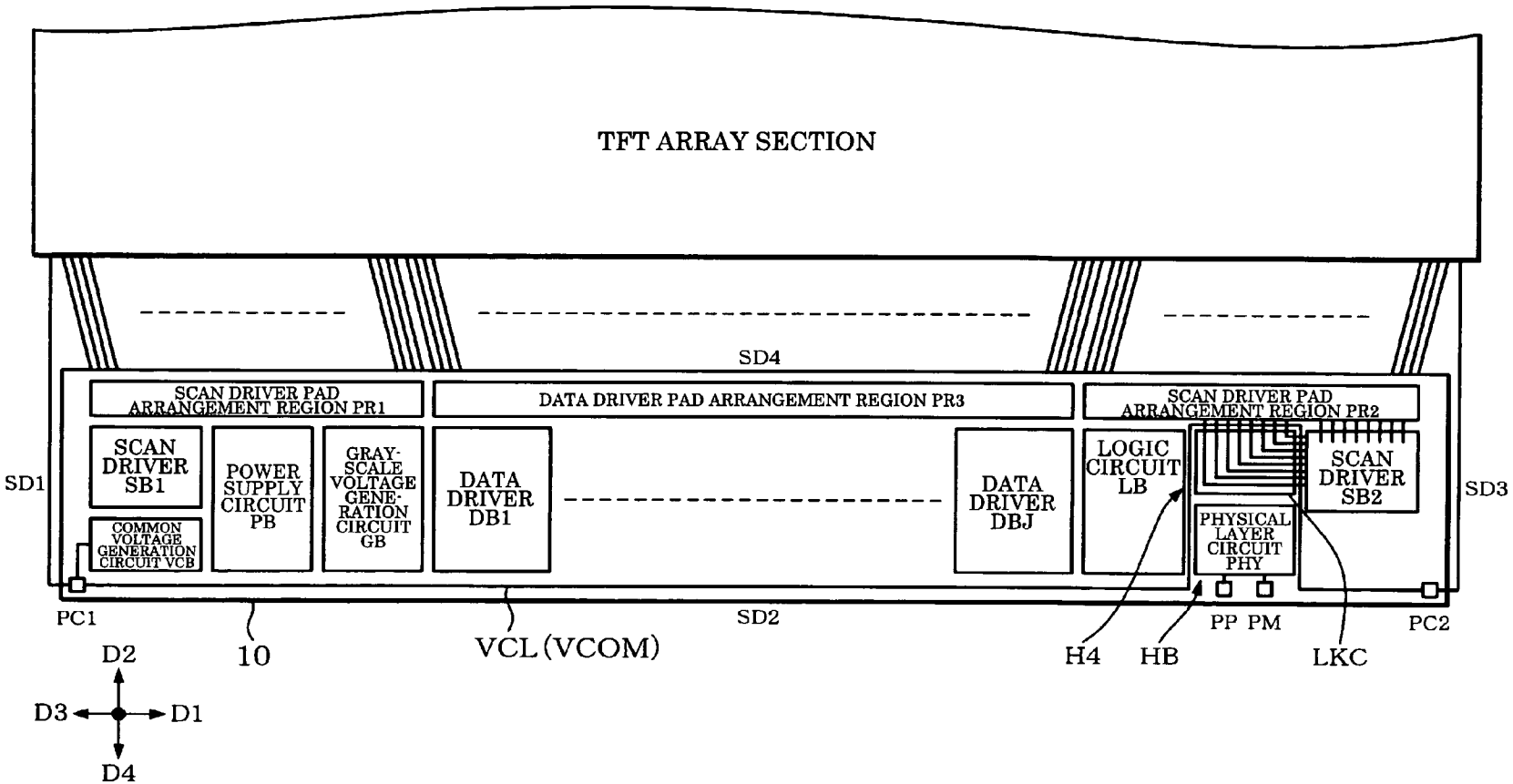
FIG. 10 shows a detailed layout example of an integrated circuit device.

FIG. 10 shows a detailed layout example of the integrated circuit device 10. The integrated circuit device 10 shown in FIG. 10 includes data driver blocks DB1 to DBJ which are disposed along the direction D1 and drive the data lines, and first and second scan driver blocks SB1 and SB2 which drive the scan lines. The integrated circuit device 10 also includes a grayscale voltage generation circuit block GB which generates grayscale voltages, a power supply circuit block PB which generates a power supply voltage, the high-speed I/F circuit block HB including the physical layer circuit PHY and the link controller LKC, the logic circuit block LB, and the common voltage generation circuit VCB.

The logic circuit block LB receives data received by the high-speed I/F circuit block HB. The logic circuit block LB transfers grayscale adjustment data for adjusting the grayscale voltage to the grayscale voltage generation circuit block GB, and transfers power supply adjustment data for adjusting the power supply voltage to the power supply circuit block PB.

In FIG. 10, the grayscale voltage generation circuit block GB is disposed in the direction D3 with respect to the data driver blocks DB1 to DBJ. Specifically, the grayscale voltage generation circuit block GB is disposed in the direction D3 with respect to the leftmost data driver block DB1. Likewise, the power supply circuit block PB is disposed in the direction D3 with respect to the data driver blocks DB1 to DBJ. Specifically, the power supply circuit block PB is disposed in the direction D3 with respect to the leftmost data driver block DB1. The high-speed I/F circuit block HB and the logic circuit block LB are disposed in the direction D1 with respect to the data driver blocks DB1 to DBJ. Specifically, the high-speed I/F circuit block HB and the logic circuit block LB are disposed in the direction D1 with respect to the rightmost data driver block DBJ.

The grayscale voltage generation circuit block GB is disposed between the first scan driver block SB1 and the data driver blocks DB1 to DBJ. The high-speed I/F circuit block HB is disposed between the second scan driver block SB2 and the data driver blocks DB1 to DBJ. The common voltage generation circuit VCB is disposed in the direction D4 with respect to the scan driver block SB1.

In FIG. 10, local lines formed of a lower interconnect layer are provided between the adjacent circuit blocks. Global lines formed of an interconnect layer positioned in an upper layer of the local lines are provided between the nonadjacent circuit blocks along the direction D1. A grayscale global line for supplying the grayscale voltage from the grayscale voltage generation circuit block GB to the data driver blocks DB1 to DBJ and a power supply global line for supplying the power supply voltage from the power supply circuit block PB are provided over the data driver blocks DB1 to DBJ along the direction D1.

When disposing the scan driver blocks SB1 and SB2 on either end of the integrated circuit device 10, as shown in FIG. 10, it is desirable to dispose the scan driver pads, through which the scan signals are output, on each end of the integrated circuit device 10 taking the wiring efficiency into consideration. On the other hand, the data driver blocks DB1 to DBJ are disposed around the center of the integrated circuit device 10. Therefore, it is desirable to dispose the data driver pads, through which the data signals are output, around the center of the integrated circuit device 10 taking the wiring efficiency into consideration.

In FIG. 10, scan driver pad arrangement regions PR1 and PR2 are provided on either end of the integrated circuit device 10, and a data driver pad arrangement region PR3 is provided between the scan driver pad arrangement regions PR1 and PR2. This ensures that the output lines of the scan driver blocks SB1 and SB2 and the output lines of the data driver blocks DB1 to DBJ can be efficiently connected with the pads in the scan driver pad arrangement regions PR1 and PR2 and the pads in the data driver pad arrangement region PR3.

In FIG. 10, the data driver blocks DB1 to DBJ are disposed around the center of the integrated circuit device 10. Therefore, the data driver pad arrangement region PR3 can be provided in the free space in the direction D2 with respect to the data driver blocks DB1 to DBJ, whereby the free space can be effectively utilized. Note that the data signal lines on the panel connected with the pads in the data driver pad arrangement region PR3 are provided in the TFT array section on the array substrate.

In FIG. 10, the grayscale voltage generation circuit block GB and the power supply circuit block PB with a large circuit area are disposed in the direction D3 with respect to the data driver blocks DB1 to DBJ. The logic circuit block LB and the high-speed I/F circuit block HB with a large circuit area are disposed in the direction D1 with respect to the data driver blocks DB1 to DBJ. According to this configuration, the scan driver pad arrangement regions PR1 and PR2 can be provided utilizing the free space formed in the direction D2 with respect to the grayscale voltage generation circuit block GB and the power supply circuit block PB with a large circuit area and the free space formed in the direction D2 with respect to the logic circuit block LB and the high-speed I/F circuit block HB. Therefore, the wiring efficiency can be increased by effectively utilizing the free space, whereby the width of the integrated circuit device 10 in the direction D2 can be reduced. Note that the scan signal lines on the panel connected with the pads in the scan driver pad arrangement regions PR1 and PR2 are provided in the TFT array section on the array substrate. The panel common voltage line is provided on the left and right of the scan signal lines.

In FIG. 10, the logic circuit block LB and the high-speed I/F circuit block HB are adjacently disposed along the direction D1. Therefore, the signal line of data received by the high-speed I/F circuit block HB can be connected with the logic circuit block LB along a short path, whereby the layout efficiency can be increased. A modification may be made in which the high-speed I/F circuit block HB (physical layer circuit) is disposed in the direction D4 with respect to the logic circuit block LB, for example.

In FIG. 10, the high-speed I/F circuit block HB is disposed in the direction D1 with respect to the data driver blocks DB1 to DBJ (i.e., the high-speed I/F circuit block HB is not disposed in the arrangement region of the data driver blocks DB1 to DBJ). Therefore, the grayscale global line and the power supply global line provided over the data driver blocks DB1 to DBJ need not pass over the high-speed I/F circuit block HB. Therefore, the high-speed I/F circuit block HB (physical layer circuit PHY) can be prevented from being adversely affected by noise from these global lines, whereby a malfunction of the high-speed I/F circuit block HB and the like can be prevented.

For example, when mounting the integrated circuit device 10 on a glass substrate (array substrate) using bumps by means of COG technology, the contact resistance of the bumps increases on each end of the integrated circuit device 10. Specifically, since the coefficient of thermal expansion differs between the integrated circuit device 10 and the glass substrate, stress (thermal stress) caused by the difference in coefficient of thermal expansion becomes greater on each end of the integrated circuit device 10 than at the center of the integrated circuit device 10. As a result, the contact resistance of the bumps increases with time on each end of the integrated circuit device 10. In particular, the narrower the integrated circuit device 10, the larger the difference in stress between each end and the center, and the greater the increase in contact resistance of the bumps on each end.

In the high-speed I/F circuit block HB, the impedance is matched between the transmission side and the reception side in order to prevent signal reflection. Therefore, an impedance mismatch may occur when the contact resistance of the bumps connected to the pads PP and PM of the high-speed I/F circuit block HB increases, whereby the signal quality of high-speed serial transfer may deteriorate. Therefore, it is desirable to dispose the high-speed I/F circuit block HB near the center of the integrated circuit device 10, taking the contact resistance into consideration.

In FIG. 10, the high-speed I/F circuit block HB is disposed between the data driver block DBJ and the scan driver block SB2 instead of on the rightmost end of the integrated circuit device 10. Therefore, an increase in contact resistance of the bumps can be suppressed within an allowable range as compared with the case of disposing the high-speed I/F circuit block HB on the rightmost end of the integrated circuit device 10. If the high-speed I/F circuit block HB is provided in the arrangement region of the data driver blocks DB1 to DBJ taking the contact resistance into consideration to a large extent, the performance of the high-speed I/F circuit block HB decreases due to the effect of noise from the global lines, as described above. According to the layout method shown in FIG. 10, deterioration in performance due to noise from the global lines can be eliminated while suppressing an increase in contact resistance within an allowable range.

6. Shield Line

When providing the long common voltage line VCL on the narrow integrated circuit device 10 along the direction D1, as shown in FIGS. 8A to 8C, the display characteristics may deteriorate if noise from other signal lines is transmitted to the common voltage line VCL. In FIGS. 8A and 8B, for example, noise from the digital signal lines connected to the logic circuit block and the like may be transmitted to the common voltage line VCL. In FIG. 8C, noise from the data signal lines from the data driver block and noise from the scan signal lines from the scan driver block may be transmitted to the common voltage line VCL.

Figure 11A:
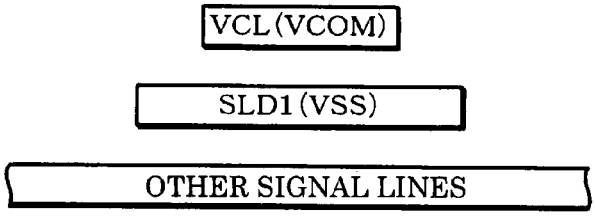
FIGS. 11A to 11C are views illustrative of a common voltage line shielding method.
Figure 11B:
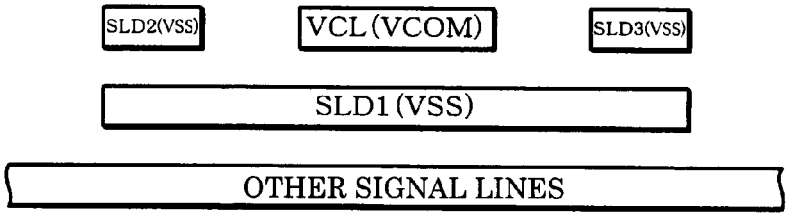
Figure 11C:
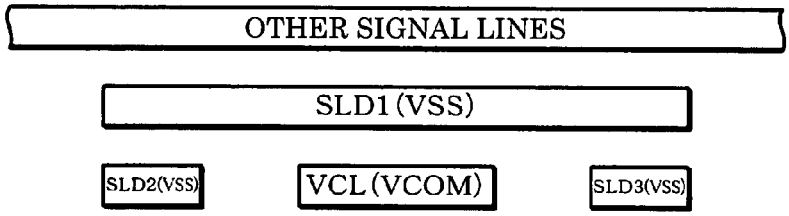

In FIGS. 11A to 11C, shield lines for preventing noise from other signal lines from being transmitted to the common voltage line VCL are provided. In FIG. 11A, for example, a first shield line SLD1 which is formed of an interconnect layer in a layer differing from the common voltage line VCL and to which a given power supply potential (e.g., VSS) is applied is provided to overlap the common voltage line VCL in plan view. Specifically, the shield line SLD1 is provided between the common voltage line VCL and other signal lines. The shield line SLD1 is formed of an interconnect layer provided between the interconnect layer forming the common voltage line VCL and the interconnect layer forming other signal lines. This enables noise from other signal lines (e.g., digital signal lines, data signal lines, and scan signal lines) to be prevented from being transmitted from the lower side of the common voltage line VCL using the shield line SLD1 provided under the common voltage line VCL.

In FIG. 11B, second shield lines SLD2 and SLD3 which are formed of the same interconnect layer as the common voltage line VCL and to which a given power supply potential (e.g., VSS) is applied are provided on either side of the common voltage line VCL. Specifically, when the common voltage line VCL is provided along the direction D1, the shield lines SLD2 and SLD3 are provided along the direction D1 in parallel to the common voltage line VCL at a specific interval from the common voltage line VCL. This enables noise from other signal lines to be prevented from being transmitted from each side of the common voltage line VCL using the shield lines SLD2 and SLD3 provided on either side of the common voltage line VCL.

In FIG. 11B, the shield line SLD1 under the common voltage line VCL is also provided in addition to the shield lines SLD2 and SLD3 on either side of the common voltage line VCL. This enables transmission of noise to the common voltage line VCL to be shielded more efficiently.

When other signal lines are provided over the common voltage line VCL, the shield lines SLD1, SLD2, and SLD3 may be provided as shown in FIG. 11C. Specifically, the shield line SLD1 is provided over the common voltage line VCL, and the shield lines SLD2 and SLD3 are provided on either side of the common voltage line VCL.

The shielding method for the common voltage line VCL described with reference to FIGS. 11A to 11C is particularly effective when providing the scan output lines from the scan driver block SB2 over the link controller LKC to avoid the physical layer circuit PHY, as indicated by H4 in FIG. 10.

As indicated by H4 in FIG. 10, the common voltage line VCL is provided in the direction D2 with respect to the link controller LKC along the direction D1 and is provided in the direction D1 with respect to the link controller LKC along the direction D4. On the other hand, the scan output lines are provided from the scan driver block SB along the direction D3, turn over the link controller LKC along the direction D3, and are input to the scan driver pad arrangement region PR2. Therefore, the common voltage line VCL intersects the scan output lines in the regions in the direction D2 and the direction D1 with respect to the link controller LKC, as indicated by H4 in FIG. 10.

The voltage level of the scan output lines changes at an amplitude of 10 to 20 V in specific cycles. Therefore, signal noise caused by a change in the voltage level of the scan output lines may be transmitted to the common voltage line VCL through parasitic capacitors, whereby the display characteristics may deteriorate.

In this case, a change in the voltage level of the scan output lines is shielded by the shield lines SLD1 to SLD3 and the like and is prevented from being transmitted to the common voltage line VCL by employing the shielding method described with reference to FIGS. 11A to 11C. Since the common voltage line VCL and the scan output lines need not be provided over the physical layer circuit PHY, a malfunction of the physical layer circuit PHY can be prevented. As a result, deterioration in display characteristics due to noise superimposed on the common voltage line VCL can be prevented while preventing a malfunction of the physical layer circuit PHY.

7. Circuit Configuration Example of Integrated Circuit Device

Figure 12:
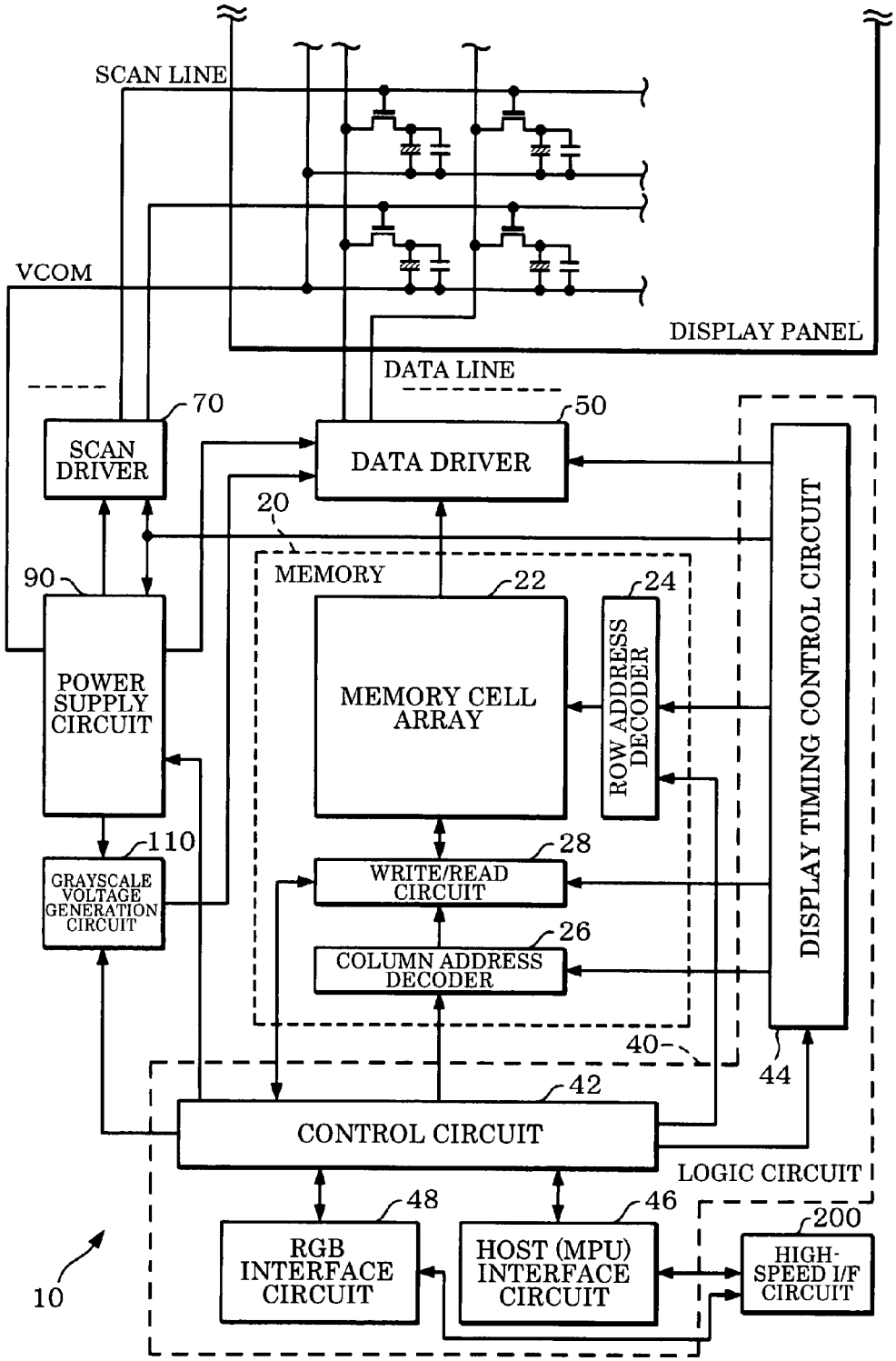
FIG. 12 shows a circuit configuration example of an integrated circuit device.

FIG. 12 shows a circuit configuration example of the integrated circuit device (display driver) according to this embodiment. The integrated circuit device according to this embodiment is not limited to the circuit configuration shown in FIG. 12. Various modifications may be made such as omitting some elements or adding other elements.

A display panel includes data lines (source lines), scan lines (gate lines), and pixels, each of the pixels being specified by one of the data lines and one of the scan lines. A display operation is implemented by changing the optical properties of an electro-optical element (liquid crystal element in a narrow sense) in each pixel region. The display panel may be formed using an active matrix type panel using a switching element such as a TFT or TFD. The display panel may be a panel other than the active matrix type panel, or may be a panel (e.g. organic EL panel) other than the liquid crystal panel.

A memory 20 (display data RAM) stores image data. A memory cell array 22 includes memory cells, and stores image data (display data) of at least one frame (one screen). A row address decoder 24 (MPU/LCD row address decoder) decodes a row address, and selects a wordline of the memory cell array 22. A column address decoder 26 (MPU column address decoder) decodes a column address, and selects a bitline of the memory cell array 22. A write/read circuit 28 (MPU write/read circuit) writes image data into the memory cell array 22 or reads image data from the memory cell array 22.

A logic circuit 40 (driver logic circuit) generates a control signal for controlling the display timing, a control signal for controlling the data processing timing, and the like. The logic circuit 40 may be formed by automatic placement and routing (e.g., gate array (G/A)), for example.

A control circuit 42 generates various control signals, and controls the entire device. Specifically, the control circuit 42 outputs grayscale adjustment data (gamma correction data) for adjusting grayscale characteristics (gamma characteristics) to a grayscale voltage generation circuit 110, and outputs power supply adjustment data for adjusting the power supply voltage to a power supply circuit 90. The control circuit 42 also controls a memory write/read process using the row address decoder 24, the column address decoder 26, and the write/read circuit 28. A display timing control circuit 44 generates various control signals for controlling the display timing, and controls reading of image data from the memory 20 into the display panel. A host (MPU) interface circuit 46 implements a host interface for generating an internal pulse and accessing the memory 20 on each occasion of access from a host. An RGB interface circuit 48 implements an RGB interface for writing video image RGB data into the memory 20 based on a dot clock signal. The integrated circuit device may be configured to include only one of the host interface circuit 46 and the RGB interface circuit 48.

A data driver 50 is a circuit which generates a data signal for driving the data line of the display panel. Specifically, the data driver 50 receives the image data (grayscale data) from the memory 20, and receives a plurality of (e.g. 256 stages) grayscale voltages (reference voltages) from the grayscale voltage generation circuit 110. The data driver 50 selects the voltage corresponding to the image data from the grayscale voltages, and outputs the selected voltage to the data line of the display panel as the data signal (data voltage).

A scan driver 70 is a circuit which generates a scan signal for driving the scan line of the display panel. Specifically, the scan driver 70 sequentially shifts a signal (enable input/output signal) using a built-in shift register, and outputs a signal obtained by converting the level of the shifted signal to each scan line of the display panel as the scan signal (scan voltage). The scan driver 70 may include a scan address generation circuit and an address decoder. The scan address generation circuit may generate and output a scan address, and the address decoder may decode the scan address to generate the scan signal.

The power supply circuit 90 is a circuit which generates various power supply voltages. Specifically, the power supply circuit 90 increases an input power supply voltage or an internal power supply voltage by a charge-pump method using a boost capacitor and a boost transistor included in a voltage booster circuit provided in the power supply circuit 90. The power supply circuit 90 supplies the resulting voltages to the data driver 50, the scan driver 70, the grayscale voltage generation circuit 110, and the like.

The grayscale voltage generation circuit 110 (gamma correction circuit) is a circuit which generates the grayscale voltage and supplies the grayscale voltage to the data driver 50. Specifically, the grayscale voltage generation circuit 110 may include a ladder resistor circuit which divides the voltage between the high-potential-side power supply and the low-potential-side power supply using resistors, and outputs the grayscale voltages to resistance division nodes. The grayscale voltage generation circuit 110 may also include a grayscale register section into which the grayscale adjustment data is written, a grayscale voltage setting circuit which variably sets (controls) the grayscale voltage output to the resistance division node based on the written grayscale adjustment data, and the like.

Figure 13A:
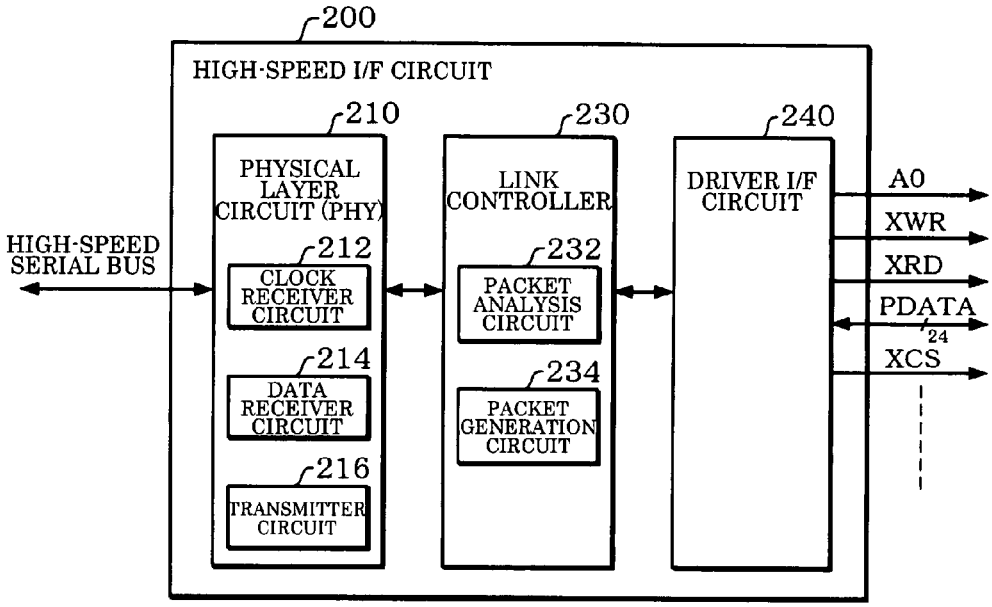
FIGS. 13A and 13B show a configuration example of a high-speed I/F circuit and a physical layer circuit.

A high-speed I/F circuit 200 (serial interface circuit) is a circuit which implements a high-speed serial transfer through a serial bus. Specifically, the high-speed I/F circuit 200 implements a high-speed serial transfer between the integrated circuit device and the host (host device) by current-driving or voltage-driving differential signal lines of the serial bus. FIG. 13A shows a configuration example of the high-speed I/F circuit 200.

A physical layer circuit 210 (transceiver) is a circuit which receives or transmits data (packet) and a clock signal using differential signals (differential data signals and differential clock signals). Specifically, the physical layer circuit 210 transmits or receives data and the like by current-driving or voltage-driving differential signal lines of the serial bus. The physical layer circuit 210 may include a clock receiver circuit 212, a data receiver circuit 214, a transmitter circuit 216, and the like.

The link controller 230 performs a process of a link layer (or transaction layer) higher than the physical layer. Specifically, the link controller 230 may include a packet analysis circuit 232. When the physical layer circuit 210 has received a packet from the host (host device) through the serial bus, the packet analysis circuit 232 analyzes the received packet. Specifically, the packet analysis circuit 232 separates the header and data of the received packet and extracts the header. b The link controller 230 may include a packet generation circuit 234. The packet generation circuit 234 generates a packet when transmitting a packet to the host through the serial bus. Specifically, the packet generation circuit 234 generates the header of the packet to be transmitted, and assembles the packet by combining the header and data. The packet generation circuit 234 directs the physical layer circuit 210 to transmit the generated packet.

The driver I/F circuit 240 performs an interface process between the high-speed I/F circuit 200 and an internal circuit of the display driver. Specifically, the driver I/F circuit 240 generates host interface signals including an address 0 signal A0, a write signal XWR, a read signal XRD, a parallel data signal PDATA, a chip select signal XCS, and the like, and outputs the generated signals to the internal circuit (host interface circuit 46) of the display driver.

Figure 13B:
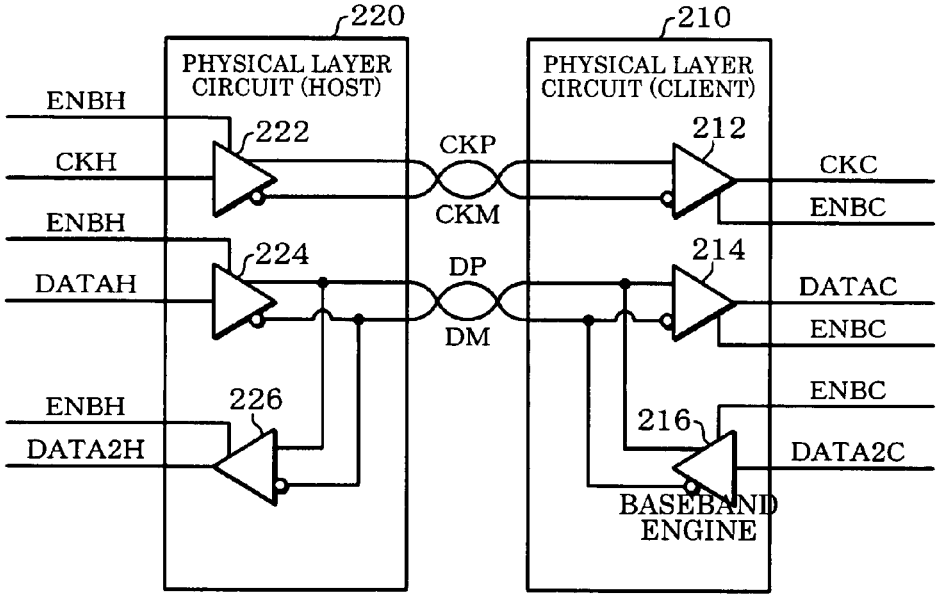

In FIG. 13B, a physical layer circuit 220 is provided in the host device, and the physical layer circuit 210 is provided in the display driver. Reference numerals 212, 214, and 226 indicate receiver circuits, and reference numerals 216, 222, and 224 indicate transmitter circuits. The operations of the receiver circuits 212, 214, and 226 and the transmitter circuits 216, 222, and 224 are enabled or disabled using enable signals ENBH and ENBC.

The host-side clock transmitter circuit 222 outputs differential clock signals CKP and CKM. The client-side clock receiver circuit 212 differentially amplifies the differential clock signals CKP and CKM, and outputs the resulting clock signal CKC to the circuit in the subsequent stage.

The host-side data transmitter circuit 224 outputs differential data signals DP and DM. The client-side data receiver circuit 214 differentially amplifies the differential data signals DP and DM, and outputs the resulting data DATAC to the circuit in the subsequent stage. In FIG. 13B, data can be transferred from the client to the host using the client-side data transmitter circuit 216 and the host-side data receiver circuit 226.

The configuration of the physical layer circuit 210 is not limited to FIGS. 13A and 13B. Various modifications may be made. For example, the physical layer circuit 210 may include a serial/parallel conversion circuit, a parallel/serial conversion circuit, and the like (not shown). Or, the physical layer circuit 210 may include a phase locked loop (PLL) circuit, a bias voltage generation circuit, and the like. The differential signal lines of the serial bus may have a multi-channel configuration. The physical layer circuit 210 includes at least one of the receiver circuit and the transmitter circuit. For example, the physical layer circuit 210 may not include the transmitter circuit. A sampling clock signal may be generated based on the received data without providing the clock receiver circuit.

8. Narrow Integrated Circuit Device

Figure 14:
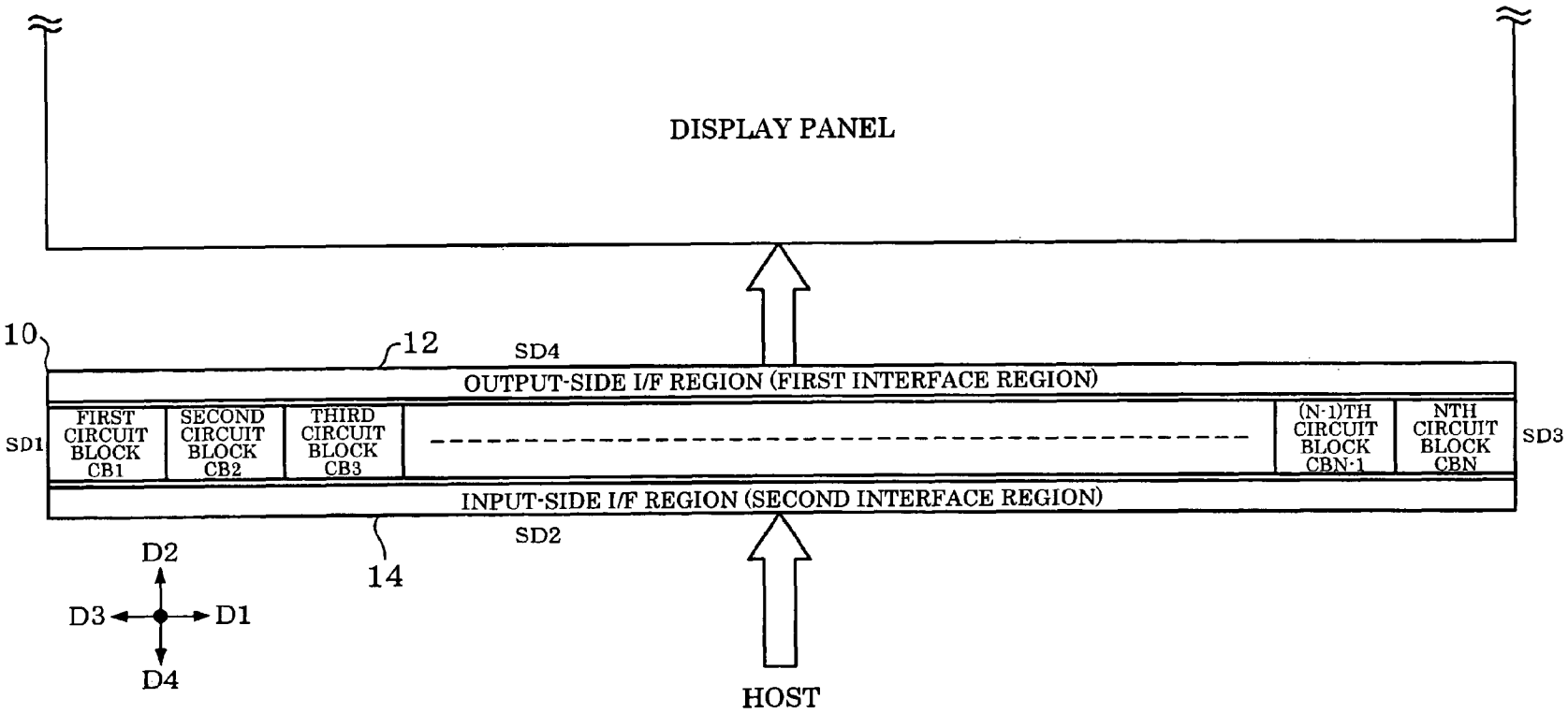
FIG. 14 shows an arrangement configuration example of an integrated circuit device.

FIG. 14 shows an arrangement example of the integrated circuit device 10. The integrated circuit device 10 includes first to Nth circuit blocks CB1 to CBN (N is an integer equal to or larger than two) disposed along the direction D1. The integrated circuit device 10 includes an output-side I/F region 12 (first interface region in a broad sense) provided along the side SD4 in the direction D2 with respect to the first to Nth circuit blocks CB1 to CBN. The integrated circuit device 10 includes an input-side I/F region 14 (second interface region in a broad sense) provided along the side SD2 in the direction D4 with respect to the first to Nth circuit blocks CB1 to CBN. Specifically, the output-side I/F region 12 is disposed in the direction D2 with respect to the circuit blocks CB1 to CBN without another circuit block or the like provided in between, for example. When the integrated circuit device 10 is used as an intellectual property (IP) core and is incorporated in another integrated circuit device, at least one of the output-side I/F region 12 and the input-side I/F region 14 (first and second I/O regions) may be omitted from the integrated circuit device 10.

The output-side (display panel side) I/F region 12 is a region which serves as an interface between the integrated circuit device 10 and the display panel, and may include pads and elements connected to the pads, such as output transistors and protective elements. Specifically, the output-side I/F region 12 may include output transistors for outputting the data signals to the data lines and outputting the scan signals to the scan lines, for example. When the display panel is a touch panel or the like, the output-side I/F region 12 may include input transistors.

The input-side (host-side) I/F region 14 is a region which serves as an interface between the integrated circuit device 10 and a host (MPU, image processing controller, or baseband engine), and may include pads and elements connected to the pads, such as input (input/output) transistors, output transistors, and protective elements. Specifically, the input-side I/F region 14 may include input transistors for inputting signals (digital signals) from the host, output transistors for outputting signals to the host, and the like.

An output-side I/F region or an input-side I/F region may be provided along the short side SD1 or SD3. Bumps serving as external connection terminals and the like may be provided in the I/F (interface) regions 12 and 14, or may be provided in a region (first to Nth circuit blocks CB1 to CBN) other than the I/F (interface) regions 12 and 14. When providing the bumps in a region other than the I/F regions 12 and 14, the bumps are formed using a small bump technology (e.g. bump technology using a resin core) other than a gold bump technology.

The first to Nth circuit blocks CB1 to CBN may include at least two (or three) different circuit blocks (circuit blocks having different functions). For example, when the integrated circuit device 10 is a display driver, the circuit blocks CB1 to CBN may include at least two of a data driver block, a memory block, a scan driver block, a logic circuit block, a grayscale voltage generation circuit block, and a power supply circuit block. Specifically, the circuit blocks CB1 to CBN may include at least a data driver block and a logic circuit block, and may further include a grayscale voltage generation circuit block. When the integrated circuit device 10 includes a built-in memory, the circuit blocks CB1 to CBN may include a memory block.

Figure 15A:
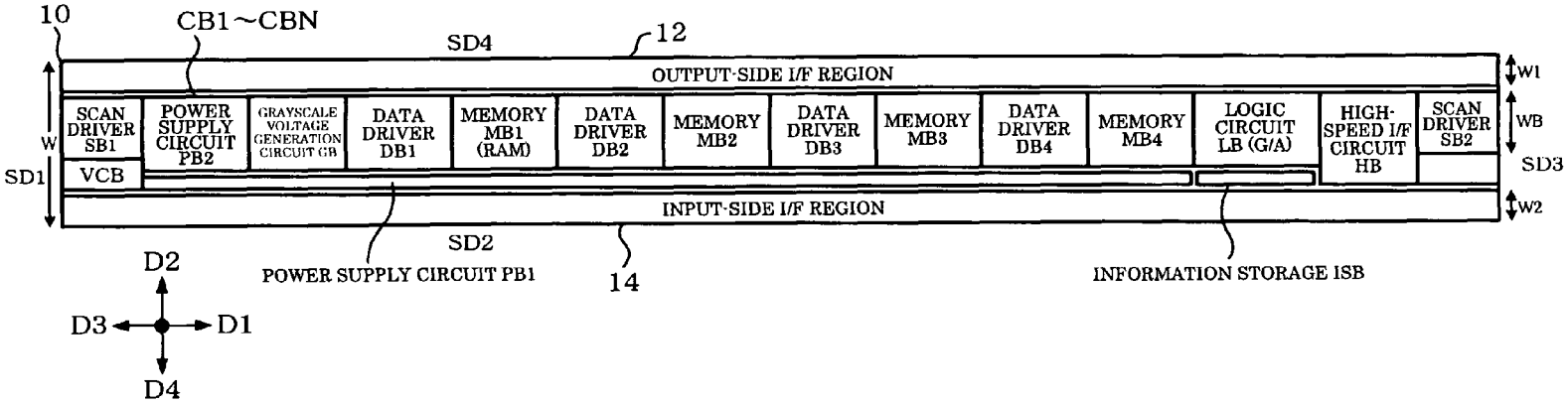
FIGS. 15A and 15B show planar layout examples of an integrated circuit device.
Figure 15B:
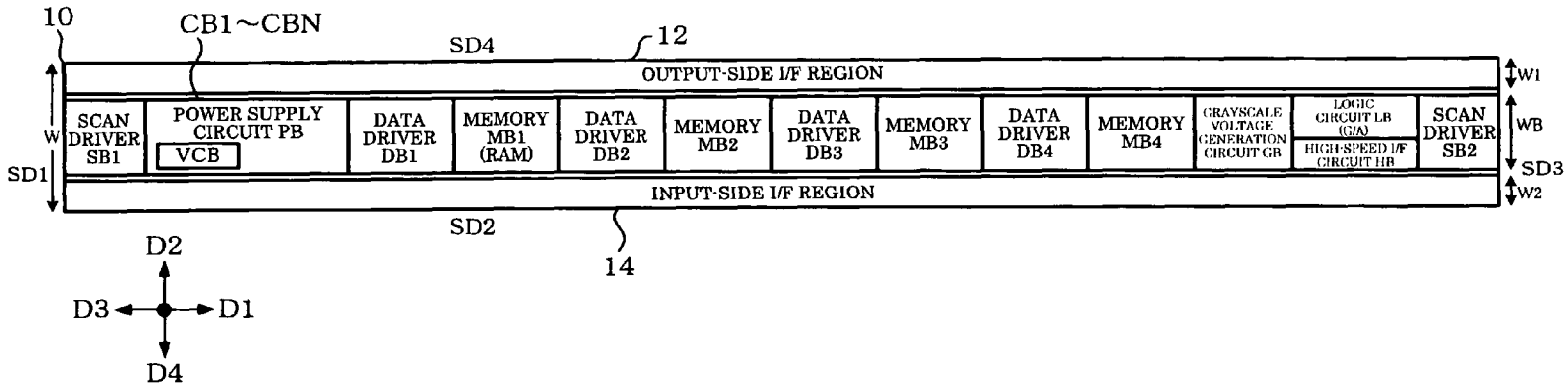

FIGS. 15A and 15B show detailed examples of the planar layout of the integrated circuit device 10. In FIGS. 15A and 15B, the first to Nth circuit blocks CB1 to CBN include first to fourth memory blocks MB1 to MB4 (first to Ith memory blocks in a broad sense; I is an integer equal to or larger than two). The first to Nth circuit blocks CB1 to CBN include first to fourth data driver blocks DB1 to DB4 (first to Ith data driver blocks in a broad sense) respectively disposed adjacent to the first to fourth memory blocks MB1 to MB4 along the direction D1. Specifically, the memory block MB1 and the data driver block DB1 are adjacently disposed along the direction D1, and the memory block MB2 and the data driver block DB2 are adjacently disposed along the direction D1. The memory block MB1 adjacent to the data driver block DB1 stores image data (display data) for the data driver block DB1 to drive the data line, and the memory block MB2 adjacent to the data driver block DB2 stores image data for the data driver block DB2 to drive the data line.

In FIGS. 15A and 15B, scan driver blocks SB1 and SB2 are disposed on either end of the integrated circuit device 10. A modification may be made in which only one of the scan driver blocks SB1 and SB2 is provided or the scan driver blocks SB1 and SB2 are not provided.

In FIG. 15A, the grayscale voltage generation circuit block GB and the power supply circuit block PB2 are disposed in the direction D3 with respect to the data driver blocks DB1 to DB4 (memory blocks MB1 to MB4). The logic circuit block LB and the high-speed I/F circuit block HB are disposed in the direction D1 with respect to the data driver blocks DB1 to DB4 (MB1 to MB4). The grayscale voltage generation circuit block GB is disposed between the power supply circuit block PB2 and the data driver blocks DB1 to DB4 (MB1 to MB4). The logic circuit block LB and the high-speed I/F circuit block HB are adjacently disposed along the direction D1. An information storage block ISB is provided in the direction D4 with respect to the logic circuit block LB.

In FIG. 15A, a narrow power supply circuit block PB1 is disposed along the direction D1 between the circuit blocks CB1 to CBN (data driver blocks DB1 to DB4) and the input-side I/F region 14 (second interface region). The power supply circuit block PB1 is a circuit block which has a long side along the direction D1 and a short side along the direction D2 and has a significantly small width in the direction D2 (narrow circuit block with a width equal to or less than a width WB). The power supply circuit block PB1 may include boost transistors of a voltage booster circuit which increases voltage by a charge-pump operation, a boost control circuit, and the like. The power supply circuit block PB2 may include a power supply register section into which power supply adjustment data for adjusting the power supply voltage is written, a regulator which regulates voltage increased by a voltage booster circuit which increases voltage by a charge pump operation, and the like.

In FIG. 15B, the grayscale voltage generation circuit block GB and the logic circuit block LB are disposed adjacently. The data driver blocks DB1 to DB4 (MB1 to MB4) are disposed between the power supply circuit block PB and the grayscale voltage generation circuit block GB and the logic circuit block LB. This enables the grayscale voltage setting signal from the logic circuit block LB to be input to the grayscale voltage generation circuit block GB along a short path.

In FIG. 15B, the high-speed I/F circuit block HB (physical layer circuit) is disposed in the direction D4 with respect to the logic circuit block LB. This enables the differential input signals from the differential input pads to be input to the high-speed I/F circuit block HB along a short path while enabling the signal from the high-speed I/F circuit block HB to be input to the logic circuit block LB along a short path.

The layout arrangement of the integrated circuit device 10 according to this embodiment is not limited to those shown in FIGS. 15A and 15B. For example, the number of memory blocks or data driver blocks may be two, three, or five or more, or the memory block and the data driver block may not be divided into subblocks. A modification may also be made in which the memory block is not adjacent to the data driver block. A configuration may be employed in which the memory block, the scan driver block, the power supply circuit block, the grayscale voltage generation circuit block, or the like is not provided. For example, the memory block may be omitted when the integrated circuit device 10 does not include a memory. The scan driver block may be omitted when the scan driver can be formed on the glass substrate of the display panel. In a display driver for a color super twisted nematic (CSTN) panel or a thin film diode (TFD) panel, the grayscale voltage generation circuit block may be omitted. A circuit block having a significantly small width in the direction D2 (narrow circuit block with a width equal to or less than the width WB) may be provided between the circuit blocks CB1 to CBN and the output-side I/F region 12 or the input-side I/F region 14. The circuit blocks CB1 to CBN may include a circuit block in which different circuit blocks are arranged in stages along the direction D2. For example, the scan driver circuit and the power supply circuit may be integrated into one circuit block.

Figure 16A:
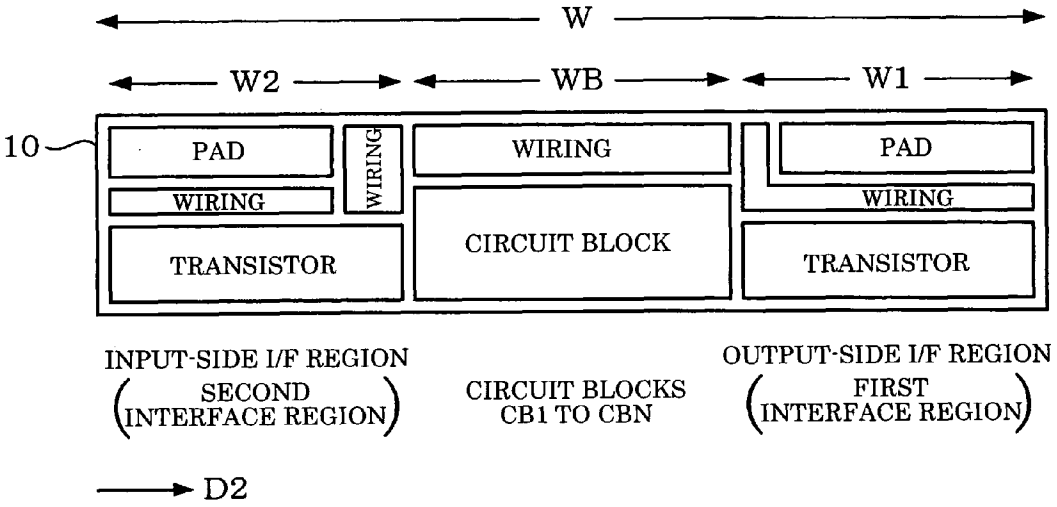
FIGS. 16A and 16B are examples of cross-sectional views of an integrated circuit device.

FIG. 16A shows an example of a cross-sectional view of the integrated circuit device 10 along the direction D2. W1, WB, and W2 respectively indicate the widths of the output-side I/F region 12, the circuit blocks CB1 to CBN, and the input-side I/F region 14 in the direction D2. The widths W1, WB, and W2 indicate the widths (maximum widths) of the transistor formation regions (bulk region or active region) of the output-side I/F region 12, the circuit blocks CB1 to CBN, and the input-side I/F region 14, respectively, and exclude the bump formation regions. W indicates the width of the integrated circuit device 10 in the direction D2. In this case, the relationship $W1+WB+W2 \leqq W < W1+2\times WB+W2$ is satisfied, for example. Or, since $W1+W2<WB$ is satisfied, $W<2\times WB$ is satisfied.

Figure 16B:
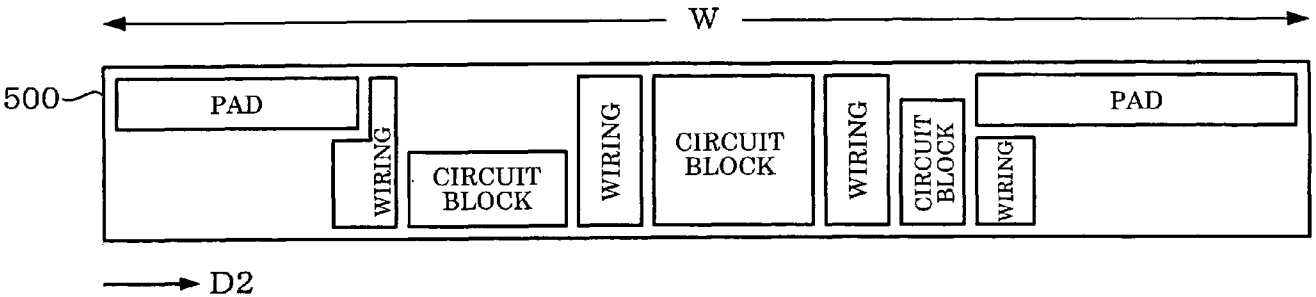

According to the arrangement method shown in FIG. 16B, two or more circuit blocks having a large width in the direction D2 are disposed along the direction D2. Specifically, the data driver block and the memory block are disposed along the direction D2.

In FIG. 16B, image data from the host is written into the memory block, for example. The data driver block converts the digital image data written into the memory block into an analog data voltage, and drives the data line of the display panel. Therefore, the image data signal flows along the direction D2. In FIG. 16B, the memory block and the data driver block are disposed along the direction D2 corresponding to the signal flow.

However, the arrangement method shown in FIG. 16B has the following problems.

First, a reduction in chip size is required for an integrated circuit device such as a display driver in order to reduce cost. However, if the chip size is reduced by merely shrinking the integrated circuit device using a microfabrication technology, the size of the integrated circuit device is reduced not only in the short side direction but also in the long side direction. This makes mounting difficult due to the narrow pitch.

Second, the configurations of the memory and the data driver of the display driver are changed depending on the type of display panel (amorphous TFT or low-temperature polysilicon TFT), the number of pixels (QCIF, QVGA, or VGA), the specification of the product, and the like. According to the arrangement method shown in FIG. 16B, even if the pad pitch, the cell pitch of the memory, and the cell pitch of the data driver coincide in a certain product, the pitches do not coincide when the configurations of the memory and the data driver are changed. If the pitches do not coincide, an unnecessary wiring region must be formed between the circuit blocks in order to absorb the difference in pitch. As a result, the width of the integrated circuit device in the direction D2 increases, whereby cost is increased due to an increase in the chip area. If the layout of the memory and the data driver is changed so that the pad pitch coincides with the cell pitch in order to avoid such a situation, the development period increases, whereby cost is increased.

According to the arrangement method shown in FIGS. 14 to 15B, the circuit blocks CB1 to CBN are disposed along the direction D1. In FIG. 16A, the transistor (circuit element) can be disposed under the pad (bump) (active surface bump). Moreover, signal lines between the circuit blocks and between the circuit block and the I/F region can be formed using global lines formed in an upper layer (lower layer of the pads) of local lines provided in the circuit blocks. Therefore, the width W of the integrated circuit device 10 in the direction D2 can be reduced while maintaining the length of the integrated circuit device 10 in the direction D1, whereby a narrow chip can be realized.

According to the arrangement method shown in FIGS. 14 to 15B, since the circuit blocks CB1 to CBN are disposed along the direction D1, it is possible to easily deal with a change in product specification and the like. Specifically, products of various specifications can be designed using a common platform, whereby the design efficiency can be improved. For example, when the number of pixels or the number of grayscales of the display panel is increased or decreased, it is possible to deal with such a situation by merely increasing or decreasing the number of memory blocks or data driver blocks, the image data read count in one horizontal scan period, and the like. For example, when the scan driver can be formed on the display panel such as a low-temperature polysilicon TFT panel, it suffices to remove the scan driver block from the circuit blocks CB1 to CBN. When developing a product without a memory, it suffices to remove the memory block. Even if the circuit block is removed conforming to the specification, its effects on the remaining circuit blocks are minimized, whereby the design efficiency can be improved.

According to the arrangement method shown in FIGS. 14 to 15B, the widths (heights) of the circuit blocks CB1 to CBN in the direction D2 can be adjusted to the width (height) of the data driver block or the memory block, for example. When the number of transistors of each circuit block is increased or decreased, it is possible to deal with such a situation by increasing or decreasing the length of each circuit block in the direction D1. Therefore, the design efficiency can be further improved. For example, when the number of transistors of each circuit block is increased or decreased due to a change in the configuration of the grayscale voltage generation circuit block or the logic circuit block, it is possible to deal with such a situation by increasing or decreasing the length of the grayscale voltage generation circuit block or the logic circuit block in the direction D1.

9. Grayscale Voltage Generation Circuit

Figure 17:
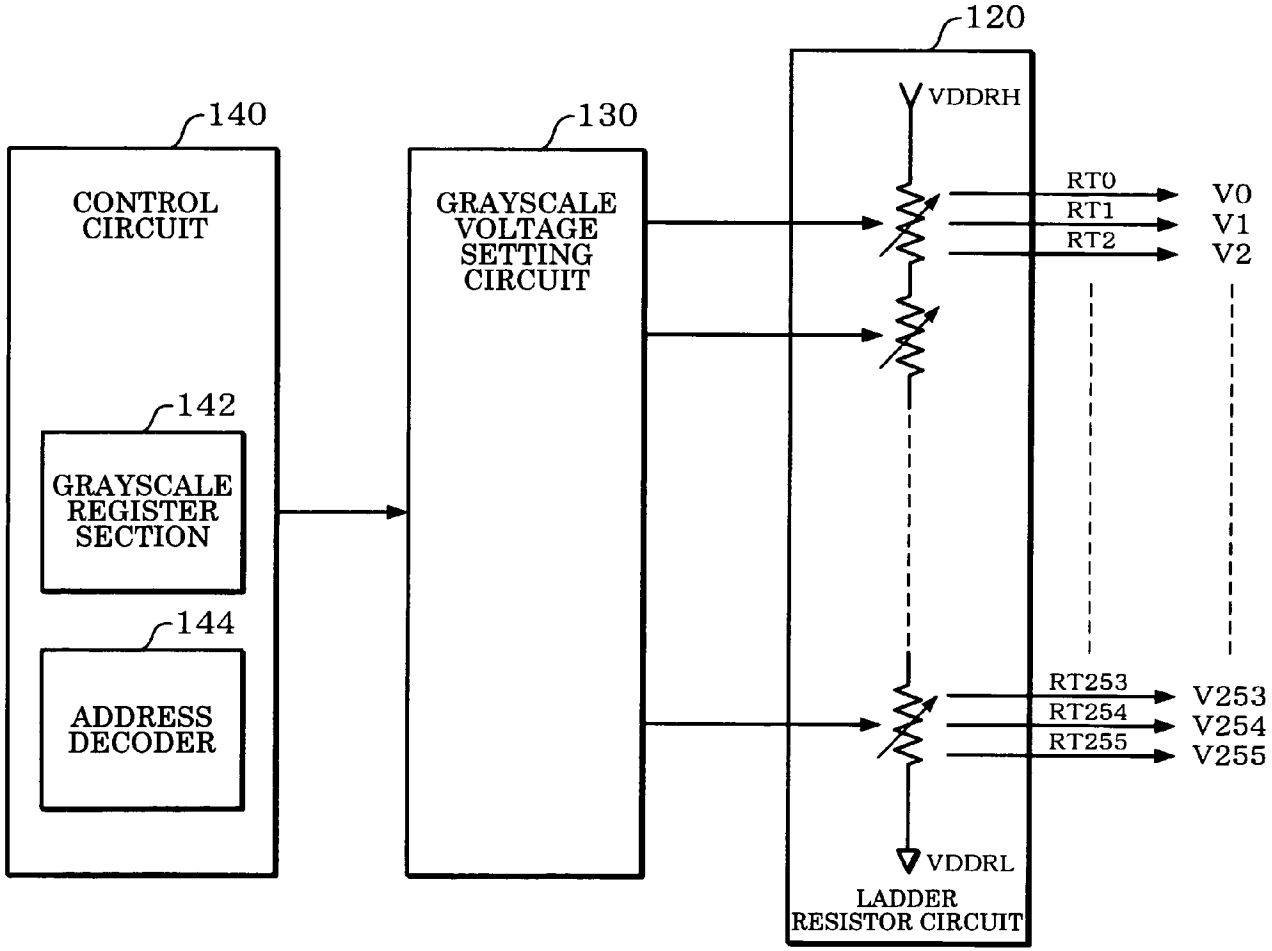
FIG. 17 shows a configuration example of a grayscale voltage generation circuit.

FIG. 17 shows a configuration example of the grayscale voltage generation circuit. The grayscale voltage generation circuit includes a ladder resistor circuit 120, a grayscale voltage setting circuit 130, and a control circuit 140.

The ladder resistor circuit 120 divides the voltage between a high-potential-side power supply (power supply voltage) VDDRH and a low-potential-side power supply (power supply voltage) VDDRL using resistors, and outputs one of grayscale voltages V0 to V255 to each of resistance division nodes RT0 to RT255.

The control circuit 140 includes a grayscale register section 142 and an address decoder 144. The grayscale adjustment data (data for adjusting grayscale characteristics) from the logic circuit (logic circuit block) is written into the grayscale register section 142. The address decoder 144 decodes an address signal from the logic circuit, and outputs a register address signal corresponding to the address signal. In the grayscale register section 142, the grayscale adjustment data is written into a register of which the register address signal from the address decoder 144 is active based on a latch signal from the logic circuit.

The grayscale voltage setting circuit 130 (grayscale selector) variably sets (controls) the grayscale voltage output to the resistance division nodes RT0 to RT255 based on the grayscale adjustment data written into the grayscale register section 142. Specifically, the grayscale voltage setting circuit 130 variably sets the grayscale voltage by variably controlling the resistance values of variable resistance circuits included in the ladder resistor circuit 120.

The grayscale voltage generation circuit is not limited to the configuration shown in FIG. 17. Various modifications may be made such as omitting some of the elements shown in FIG. 17 or adding other elements. For example, a positive ladder resistor circuit and a negative ladder resistor circuit may be provided, or a circuit (voltage-follower-connected operational amplifier) which subjects the grayscale voltage signal to impedance conversion may be provided. Or, the grayscale voltage generation circuit may include a select voltage generation circuit and a grayscale voltage select circuit. In this case, the grayscale voltage generation circuit outputs voltages obtained by division using a ladder resistor circuit included in the select voltage generation circuit as select voltages. When the number of grayscales is 256, for example, the grayscale voltage select circuit selects 64 (S in a broad sense) voltages from the select voltages from the select voltage generation circuit based on the grayscale adjustment data, and outputs the selected voltages as the grayscale voltages V0 to V255.

Figure 18A:
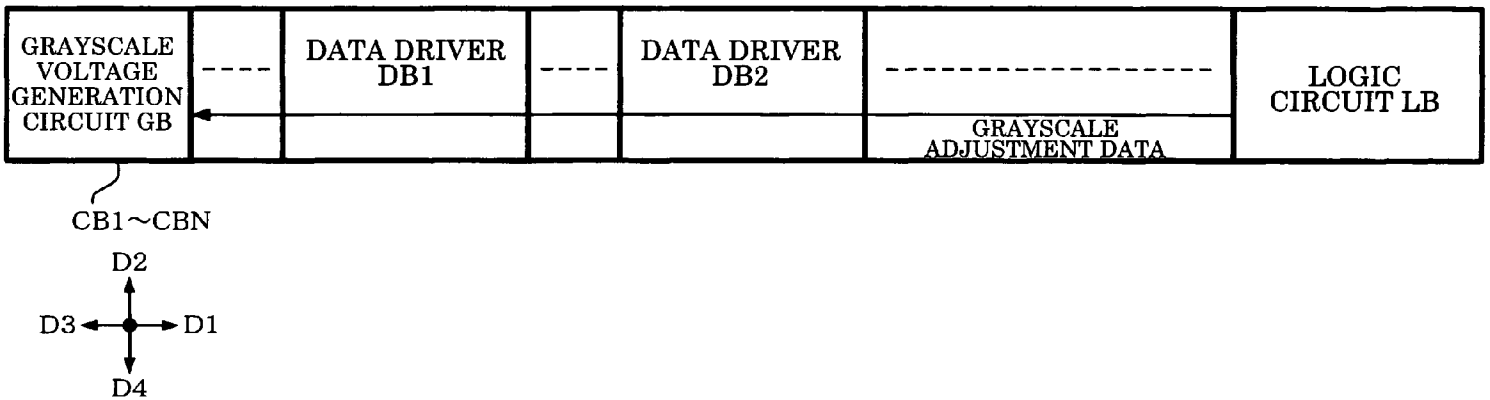
FIGS. 18A and 18B are views illustrative of an arrangement method for a grayscale voltage generation circuit block.

In FIG. 18A, the circuit blocks CB1 to CBN include the grayscale voltage generation circuit block GB, the data driver blocks DB1, DB2, . . . , and the logic circuit block LB. The logic circuit block LB transfers the grayscale adjustment data for adjusting the grayscale voltage to the grayscale voltage generation circuit block GB. The grayscale voltage generation circuit block GB generates grayscale voltages based on the transferred grayscale adjustment data. For example, the grayscale voltage generation circuit block GB adjusts the grayscale voltage, and outputs the adjusted grayscale voltage.

In FIG. 18A, the data driver block DB1, DB2, . . . are disposed between the grayscale voltage generation circuit block GB and the logic circuit block LB.

According to the layout method shown in FIG. 18A, the data driver block DB1, DB2, . . . can be disposed around the center of the integrated circuit device. Therefore, the data driver (source driver) pads and the like can be disposed by utilizing the free space in the direction D2 with respect to the data driver block DB1, DB2, . . . , whereby the free space can be effectively utilized.

According to the layout method shown in FIG. 18A, the grayscale voltage generation circuit block GB and the logic circuit block LB can be respectively disposed on the left and the right of the data driver block DB1, DB2, . . . . Therefore, the scan driver (gate driver) pads and the like can be disposed by utilizing the free space in the direction D2 with respect to the grayscale voltage generation circuit block GB and the logic circuit block LB, whereby the free space can be effectively utilized.

Figure 18B:
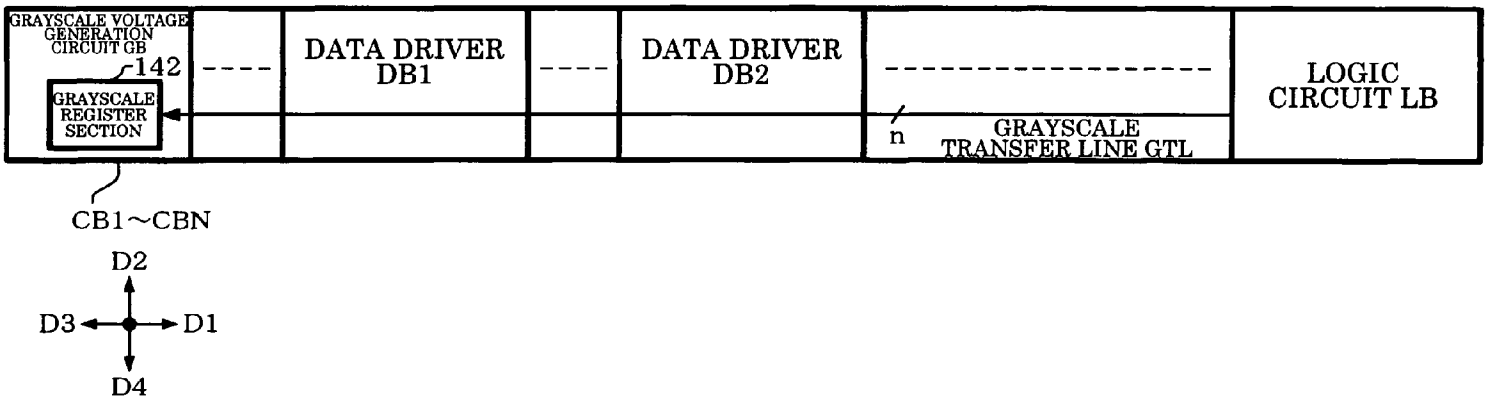

In FIG. 18B, the logic circuit block LB transfers the grayscale adjustment data (grayscale voltage adjustment data) to the grayscale voltage generation circuit block GB by time division through n-bit (n is a positive integer) grayscale transfer lines GTL. For example, the logic circuit block LB transfers (serially transfers) and writes j-bit (j>n) grayscale adjustment data into the grayscale register section 142 of the grayscale voltage generation circuit block GB by time division in units of n bits.

Specifically, it is desirable to set grayscale characteristics (gamma characteristics) optimum for the type of display panel in order to increase the display quality. When enabling the grayscale characteristics to be adjusted corresponding to the characteristics of various display panels, the amount of grayscale adjustment data increases. Therefore, when parallely writing a large amount of grayscale adjustment data into the grayscale register section 142 instead of time division, the number of bits of the transfer line increases, whereby the number of transfer lines increases. According to the layout method in which the data driver blocks DB1, DB2, . . . are disposed between the grayscale voltage generation circuit block GB and the logic circuit block LB, the number of global lines for controlling the data driver supplying the power supply voltage, and supplying the grayscale voltage is limited if the number of transfer lines increases. As a result, the width of the integrated circuit device in the direction D2 increases by the number of grayscale adjustment data transfer lines, thereby making it difficult to realize a narrow chip.

In this case, the grayscale voltage generation circuit block GB and the logic circuit block LB may be disposed adjacently, and the grayscale adjustment data may be transferred using the local lines connecting the grayscale voltage generation circuit block GB and the logic circuit block LB. According to this method, the grayscale voltage generation circuit block GB and the logic circuit block LB are disposed on the right or left of the data driver block DB1, DB2, . . . . Therefore, the free space for disposing the scan driver pads and the like is formed on the right or left of the data driver block DB1, DB2, . . . , whereby the layout efficiency decreases.

On the other hand, the number of grayscale transfer lines GTL can be reduced by transferring the grayscale adjustment data by time division, as shown in FIG. 18B. This provides a space for other global lines, whereby the width of the integrated circuit device in the direction D2 can be reduced. As a result, a narrow chip can be realized. Moreover, the free space for disposing the scan driver pads and the like is equally formed on the right or left of the data driver block DB1, DB2, . . . , whereby the layout efficiency can be increased.

A specific grayscale adjustment data transfer method is described below. In FIG. 18B, the logic circuit block LB outputs an address signal for specifying the register address of the grayscale register section 142 and a data signal for transferring the grayscale adjustment data written at the specified register address to the grayscale voltage generation circuit block GB through the grayscale transfer lines GTL. The logic circuit block LB also outputs a latch signal for capturing the data signals to the grayscale voltage generation circuit block GB. In this case, the logic circuit block LB outputs address signals in a first bit pattern in a period other than a data valid period in which valid data signals are output, for example. In a register map of the grayscale register section 142, a register into which the grayscale adjustment data is written is mapped onto a register address other than the register address corresponding to the address signals in the first bit pattern.

Figures 19A, 19B:
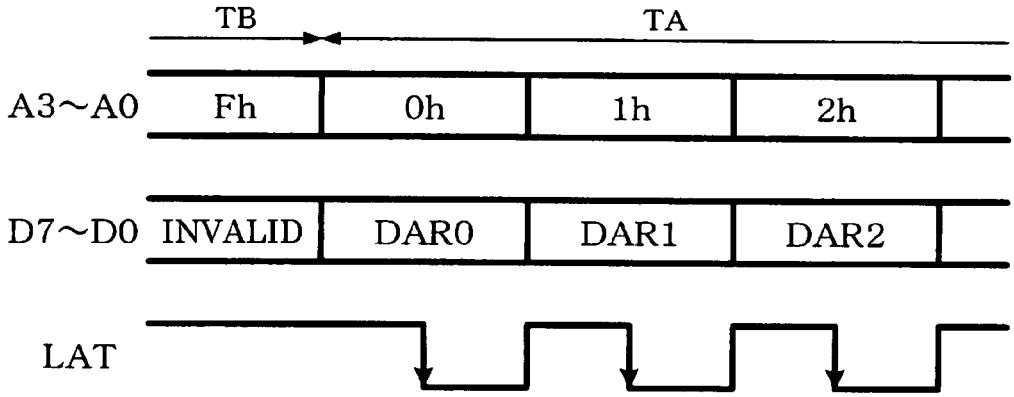
FIG. 19A shows a signal waveform example of an address signal and the like, and FIG. 19B shows a register map example.

FIG. 19A shows a signal waveform example of address signals A3 to A0, data signals D7 to D0, and a latch signal LAT.

As shown in FIG. 19A, the logic circuit block LB outputs the address signals A3 to A0 in a bit pattern (Fh)=(1111) (first bit pattern in a broad sense) in a period TB other than a data valid period TA in which the valid data signals D7 to D0 are output. Specifically, the logic circuit block LB outputs the address signals A3 to A0 in a bit pattern in which all bits are set at "1" (first logic level in a broad sense). Note that "h" means a hexadecimal notation.

In the data valid period TA, the logic circuit block LB outputs the address signals A3 to A0 corresponding to the register addresses of registers R0 to RI of the grayscale register section 142 and the data signals D7 to D0 corresponding to the grayscale adjustment data written into the registers R0 to RI. The logic circuit block LB also outputs the latch signal LAT for capturing the data signals D7 to D0. In the grayscale register section 142, the grayscale adjustment data of the data signals D7 to D0 is written into one of the registers R0 to RI specified by the register address of the address signals A3 to A0 based on the latch signal LAT (falling edge of the latch signal LAT). This causes grayscale adjustment data DAR0, DAR1, DAR2, . . . to be written into the grayscale register section 142 by time division. The numbers of bits of the address signals and the data signals are not limited to four and eight, but may be arbitrary.

FIG. 19B shows the register map of the grayscale register section 142. In this register map, the registers R0, R1, R2, . . . are mapped onto the register addresses (0h)=(0000), (1h)=(0001), (2h)=(0010), . . . of the address signals A3 to A0. The grayscale adjustment data DAR0, DAR1, DAR2, . . . set using the data signals D7 to D0 is written into the registers R0, R1, R2, . . . mapped onto the register addresses (0h), (1h), (2h), . . . . For example, the grayscale adjustment data DAR0, DAR1, and DAR2 is data for setting the slope of the grayscale characteristics in each period.

Specifically, a processing section (CPU or MPU) provided outside the integrated circuit device issues a grayscale adjustment command, and outputs a parameter as the grayscale adjustment data to the integrated circuit device. The logic circuit block LB which has received the parameter writes the grayscale adjustment data corresponding to the parameter into the registers R0 to RI of the grayscale register section 142 using the address signals A3 to A0 and the data signals D7 to D0. This enables the grayscale characteristics to be adjusted from the outside, whereby the display quality of the display panel can be increased.

When an electrostatic voltage is applied to the display panel or the like in an electrostatic discharge immunity test (ESD immunity test) or the like, noise may be superimposed on the latch signal LAT in the period TB shown in FIG. 19A. As a result, grayscale adjustment data of invalid data signals D7 to D0 may be written into the register at the register address (Fh) in the period TB other than the data valid period TA. In this case, an undesired grayscale voltage is generated. This causes a problem such as an abnormal display state of the display panel. In particular, when the distance between the logic circuit block LB and the grayscale voltage generation circuit block GB is long as in the layout example shown in FIGS. 18A and 18B, noise is easily superimposed on the signal, whereby a problem easily occurs.

In the register map of the grayscale register section 142 shown in FIG. 19B, the register of the grayscale register section 142 is not mapped onto the register address corresponding to the address signals in the bit pattern (Fh) (first bit pattern). The registers R0, R1, R2, . . . , and RI into which the grayscale adjustment data is written are mapped onto the register addresses (0h), (1h), (2h), . . . , and (Eh) other than the register address (Fh). Specifically, when the register address of the address signals A3 to A0 is (Fh), the address decoder 144 shown in FIG. 17 does not output valid register address signals. The register of the grayscale register section 142 does not store the grayscale adjustment data corresponding to the data signals D7 to D0.

According to this configuration, even if noise is superimposed on the latch signal LAT or the like in the period TB, since the register is not mapped on the register address (Fh), wrong grayscale adjustment data is not written into the register. This prevents a situation in which the display state of the display panel becomes abnormal due to application of an electrostatic voltage, whereby an integrated circuit device and an electronic instrument with high ESD immunity can be provided.

The register address of the grayscale register section 142 onto which the register is not mapped is not limited to (Fh)=(1111), differing from FIG. 19B. For example, the register address onto which the register is not mapped may be a register address (0h)=(0000) in a bit pattern in which all bits are set at "0" (second logic level in a broad sense).

10. Global Wiring Method

In order to reduce the width of the integrated circuit device in the direction D2, it is necessary to efficiently provide the signal lines and the power supply lines between the circuit blocks disposed along the direction D1. Therefore, it is desirable to provide the signal lines and the power supply lines between the circuit blocks using a global wiring method.

According to the global wiring method, local lines formed of interconnect layers (e.g. first to fourth aluminum interconnect layers ALA, ALB, ALC, and ALD) located under an Ith layer (I is an integer equal to or larger than three) are provided between the adjacent circuit blocks among the first to Nth circuit blocks CB1 to CBN. Global lines formed of an interconnect layer (e.g. fifth aluminum interconnect layer ALE) located over the Ith layer are provided between the nonadjacent circuit blocks among the first to Nth circuit blocks CB1 to CBN to pass over the circuit block disposed between the nonadjacent circuit blocks along the direction D1.

Figure 20:
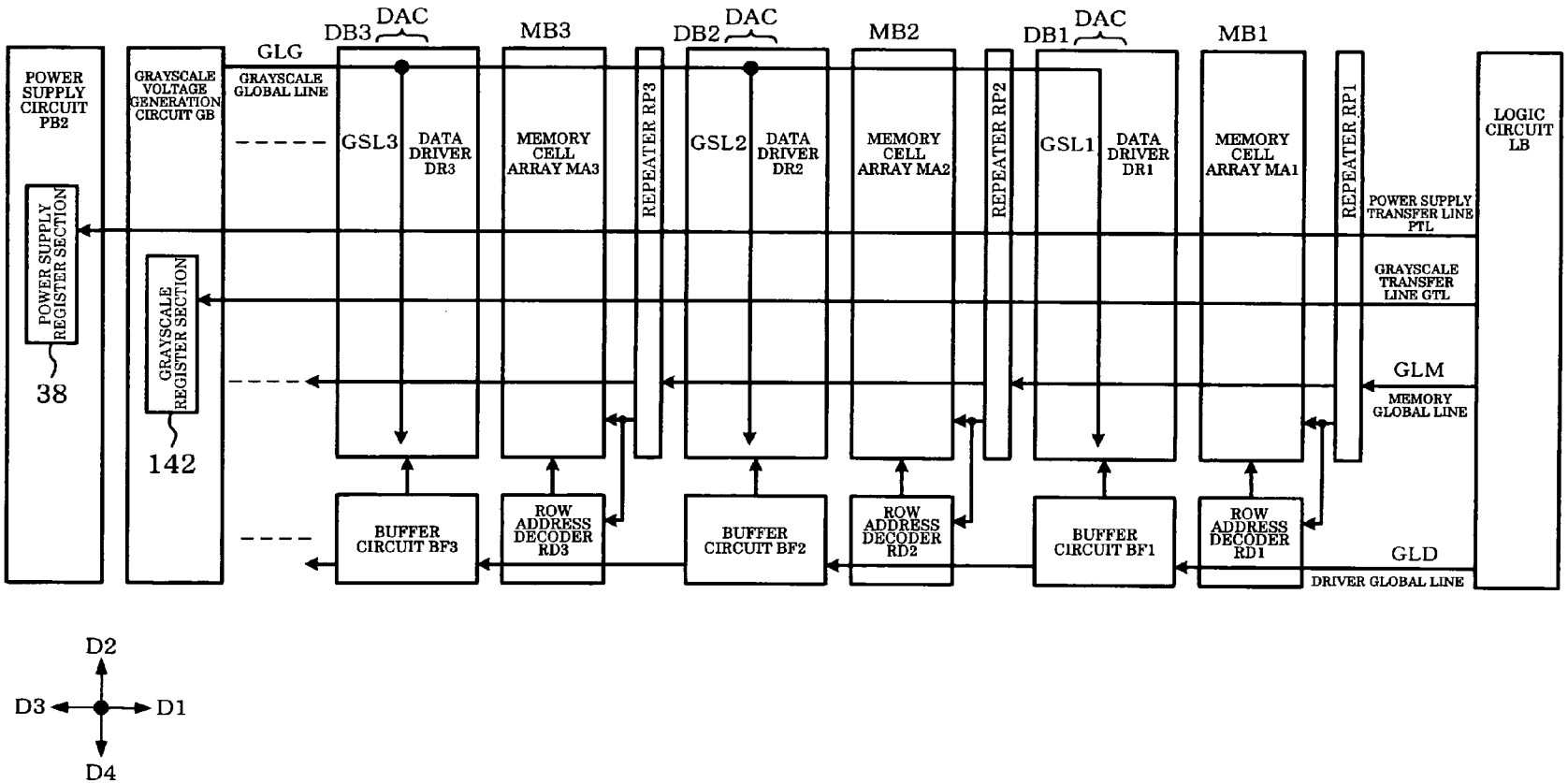
FIG. 20 is a view illustrative of a global wiring method.

FIG. 20 shows a wiring example of the global lines. In FIG. 20, a driver global line GLD for supplying a driver control signal from the logic circuit block LB to the data driver blocks DB1 to DB3 is provided over buffer circuits BF1 to BF3 and row address decoders RD1 to RD3. Specifically, the driver global line GLD formed of the fifth aluminum interconnect layer ALE (top metal) is provided almost linearly from the logic circuit block LB along the direction D1 over the buffer circuits BF1 to BF3 and the row address decoders RD1 to RD3. The driver control signal supplied through the driver global line GLD is buffered by the buffer circuits BF1 to BF3 and input to the data drivers DR1 to DR3 disposed in the direction D2 with respect to the buffer circuits BF1 to BF3.

In FIG. 20, a memory global line GLM for supplying at least a write data signal (or address signal or memory control signal) from the logic circuit block LB to the memory blocks MB1 to MB3 is provided along the direction D1. Specifically, the memory global line GLM formed of the fifth aluminum interconnect layer ALE is provided from the logic circuit block LB along the direction D1.

More specifically, repeater blocks RP1 to RP3 are disposed in FIG. 20 corresponding to the memory blocks MB1 to MB3. Each of the repeater blocks RP1 to RP3 includes a buffer which buffers at least the write data signal (or address signal or memory control signal) from the logic circuit block LB and outputs the write data signal to the memory blocks MB1 to MB3, respectively. As shown in FIG. 20, the memory blocks MB1 to MB3 and the repeater blocks RP1 to RP3 are adjacently disposed along the direction D1, respectively.

For example, when supplying the write data signal, the address signal, and the memory control signal from the logic circuit block LB to the memory blocks MB1 to MB3 using the memory global line GLM, the rising waveforms and the falling waveforms of these signals are rounded if these signals are not buffered. As a result, the time required for writing data into the memory blocks MB1 to MB3 may be increased, or a write error may occur.

On the other hand, when the repeater blocks RP1 to RP3 shown in FIG. 20 are respectively disposed adjacent to the memory blocks MB1 to MB3 in the direction D1 with respect to the memory blocks MB1 to MB3, for example, the write data signal, the address signal, and the memory control signal are buffered by the repeater blocks RP1 to RP3 and then input to the memory blocks MB1 to MB3. As a result, rounding of the rising waveforms and the falling waveforms of these signals can be reduced, whereby data can be appropriately written into the memory blocks MB1 to MB3.

In FIG. 20, the integrated circuit device includes the grayscale voltage generation circuit block GB which generates the grayscale voltage. A grayscale global line GLG (grayscale voltage supply line) for supplying the grayscale voltage from the grayscale voltage generation circuit block GB to the data driver blocks DB1 to DB3 is provided along the direction D1. Specifically, the grayscale global line GLG formed of the fifth aluminum interconnect layer ALE is provided from the grayscale voltage generation circuit block GB along the direction D1. Grayscale voltage supply lines GSL1 to GSL3 for supplying the grayscale voltage from the grayscale global line GLG to the data drivers DR1 to DR3 are respectively provided in the data drivers DR1 to DR3 along the direction D2.

In FIG. 20, the memory global line GLM is provided between the grayscale global line GLG and the driver global line GLD along the direction D1.

In FIG. 20, the buffer circuits BF1 to BF3 and the row address decoders RD1 to RD3 are disposed along the direction D1. The wiring efficiency can be significantly improved by providing the driver global line GLD along the direction D1 from the logic circuit block LB to pass over the buffer circuits BF1 to BF3 and the row address decoders RD1 to RD3.

It is necessary to supply the grayscale voltage from the grayscale voltage generation circuit block GB to the data drivers DR1 to DR3. Therefore, the grayscale global line GLG is provided along the direction D1.

The address signal, the memory control signal, and the like are supplied to the row address decoders RD1 to RD3 through the memory global line GLM. Therefore, it is desirable to provide the memory global line GLM near the row address decoders RD1 to RD3.

In FIG. 20, the memory global line GLM is provided between the grayscale global line GLG and the driver global line GLD. Therefore, the address signal, the memory control signal, and the like from the memory global line GLM can be supplied to the row address decoders RD1 to RD3 along a short path. The grayscale global line GLG can be provided almost linearly along the direction D1 on the upper side of the memory global line GLM. Accordingly, the global lines GLG, GLM, and GLD can be provided using one aluminum interconnect layer ALE without causing the global lines GLG, GLM, and GLD to intersect, whereby the wiring efficiency can be improved.

In FIG. 20, the grayscale transfer lines GTL are provided over the data driver blocks DB1 to DB3 along the direction D1 using the global lines. In this case, the grayscale adjustment data is transferred by time division through the grayscale transfer lines GTL, as described above. Therefore, the number of grayscale transfer lines GTL (global lines) can be reduced as compared with a method of transferring the grayscale adjustment data at one time using parallel transfer lines. This makes it possible to deal with a situation in which the number of global lines is limited due to an increase in the number of driver, memory, and grayscale global lines GLD, GLM, and GLG Therefore, a situation can be prevented in which the width of the integrated circuit device in the direction D2 increases due to an increase in the number of grayscale transfer lines GTL, whereby the area of the integrated circuit device can be reduced.

In FIG. 20, power supply transfer lines PTL are provided over the data driver blocks DB1 to DB3 along the direction D1 using the global lines. The logic circuit block LB transfers the power supply adjustment data to the power supply circuit block PB by time division through the m-bit (m is a positive integer) power supply transfer lines PTL. The power supply transfer lines PTL are provided along the direction D1 using the global lines. A power supply global line (not shown) for supplying the power supply voltage from the power supply circuit block PB2 to each circuit block is also provided along the direction D1.

A time division transfer of the power supply adjustment data may be implemented using a method similar to the time division transfer method for the grayscale adjustment data described with reference to FIGS. 17 to 19B. Specifically, a power supply register section 38 and an address decoder (not shown) are provided in the power supply circuit block PB2. The power supply adjustment data may be transferred through the power supply transfer lines PTL by time division using the method described with reference to FIGS. 19A and 19B, and written at each register address of the power supply register section 38.

11. Block Division

Figure 21A:
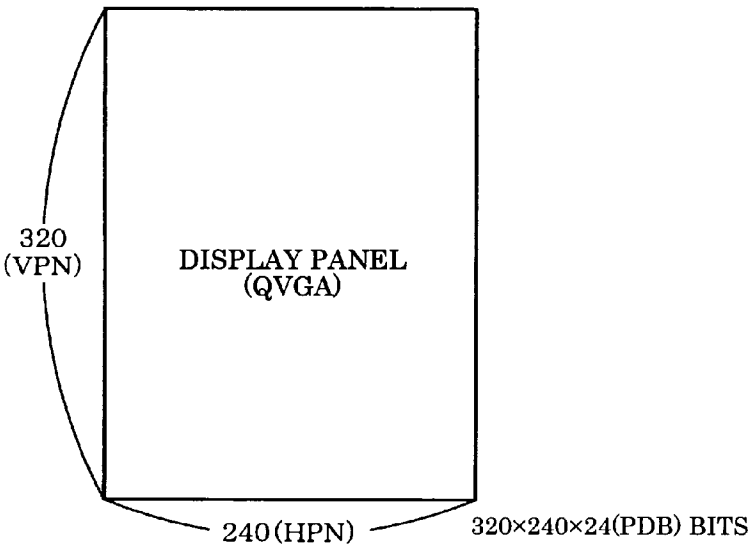
FIGS. 21A and 21B are views illustrative of a block division method for a memory and a data driver.

Suppose that the display panel is a QVGA panel in which the number of pixels in the vertical scan direction (data line direction) is VPN=320 and the number of pixels in the horizontal scan direction (scan line direction) is HPN=240, as shown in FIG. 21A. Suppose that the number of bits PDB of image (display) data of one pixel is PDB=24 bits (8 bits each for R, G, and B). In this case, the number of bits of image data necessary for displaying one frame of the display panel is VPN×HPN×PDB=320×240×24 bits. Therefore, the memory of the integrated circuit device stores at least 320×240×24 bits of image data. The data driver outputs data signals of HPN=240 data lines (data signals corresponding to 240×24 bits of image data) to the display panel in units of horizontal scan periods (in units of periods in which one scan line is scanned).

Figure 21B:
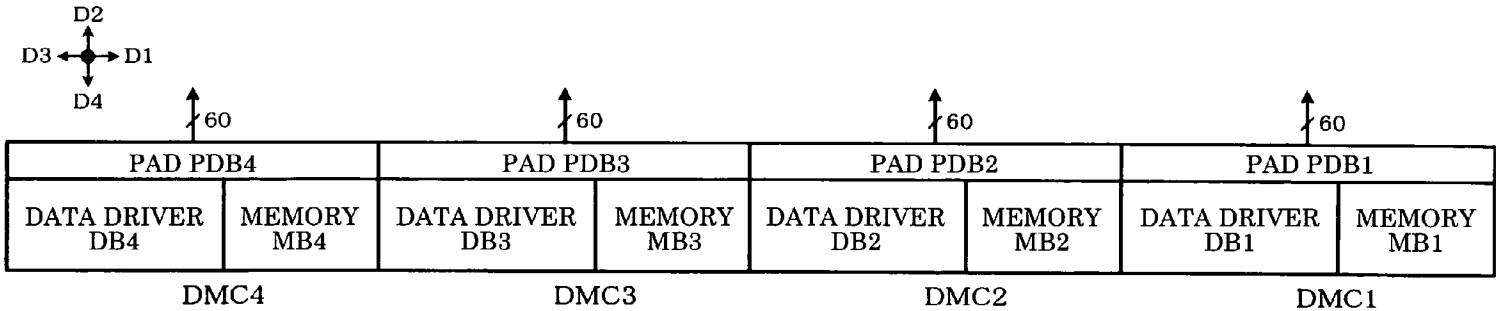

In FIG. 21B, the data driver is divided into four (DBN=4) data driver blocks DB1 to DB4. The memory is also divided into four (MBN=DBN=4) memory blocks MB1 to MB4. Specifically, four driver macrocells DMC1, DMC2, DMC3, and DMC4 are disposed along the direction D1, each of the driver macrocells DMC1, DMC2, DMC3, and DMC4 including the data driver block, the memory block, and the pad block, for example. Therefore, each of the data driver blocks DB1 to DB4 outputs the data signals of 60 (HPN/DBN=240/4=60) data lines to the display panel in units of horizontal scan periods. Each of the memory blocks MB1 to MB4 stores (VPN×HPN×PDB)/MBN=(320×240×24)/4 bits of image data.

12. Readings in One Horizontal Scan Period

In FIG. 21B, each of the data driver blocks DB1 to DB4 outputs the data signals of 60 data lines (60×3=180 data lines when three data lines are provided for R, G, and B) in one horizontal scan period. Therefore, the image data corresponding to the data signals of 240 data lines must be read from the memory blocks MB1 to MB4 corresponding to the data driver blocks DB1 to DB4 in units of horizontal scan periods.

On the other hand, when the number of bits of image data read in units of horizontal scan periods increases, it is necessary to increase the number of memory cells (sense amplifiers) arranged along the direction D2. As a result, the width W of the integrated circuit device in the direction D2 increases, whereby the width of the chip cannot be reduced. Moreover, since the length of the wordline WL increases, a signal delay of the wordline WL occurs.

In order to solve such a problem, it is desirable to employ a method in which the image data stored in the memory blocks MB1 to MB4 is read from the memory blocks MB1 to MB4 into the data driver blocks DB1 to DB4 a plurality of times (RN times) in one horizontal scan period.

Figure 22:
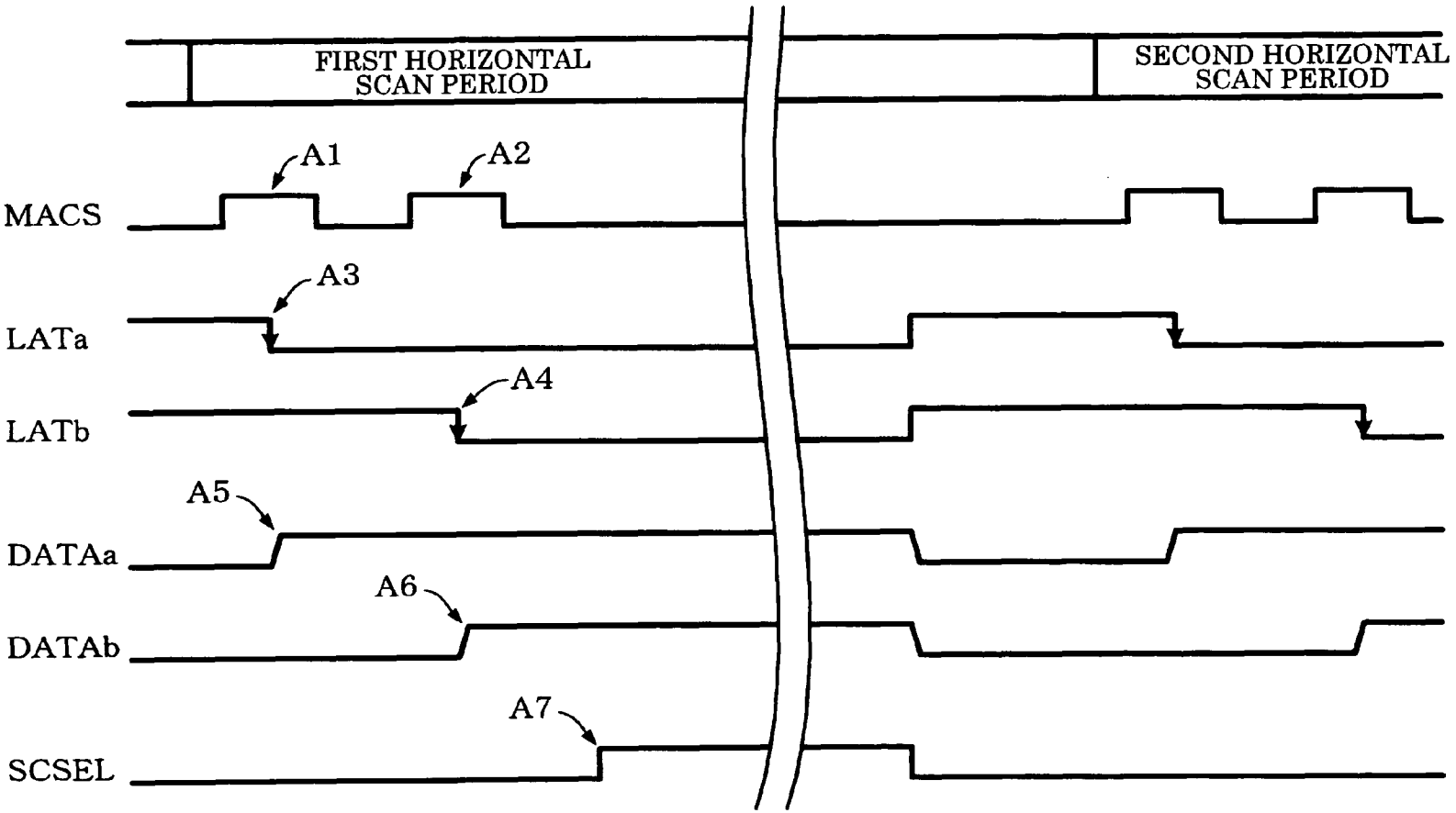
FIG. 22 is a view illustrative of a method of reading image data two or more times in one horizontal scan period.
Figure 23:
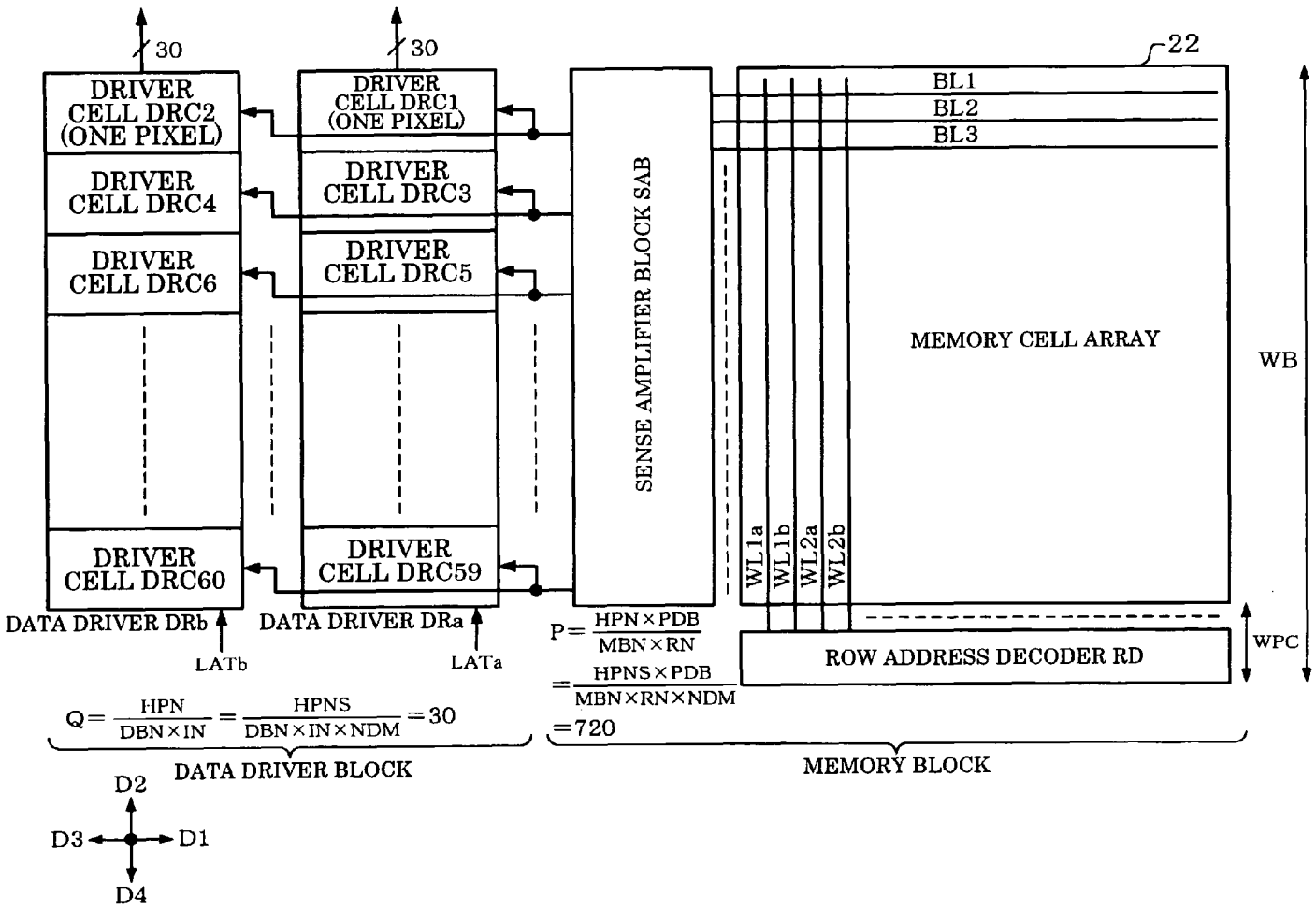
FIG. 23 shows an arrangement example of data drivers and driver cells.

In FIG. 22, a memory access signal MACS (word select signal) goes active (high level) twice (RN=2) in one horizontal scan period, as indicated by A1 and A2, for example. This causes the image data to be read from each memory block into each data driver block twice (RN=2) in one horizontal scan period. Then, data latch circuits of data drivers DRa and DRb shown in FIG. 23 provided in the data driver block latch the read image data based on latch signals LATa and LATb indicated by A3 and A4. Multiplexers of the data drivers DRa and DRb multiplex the latched image data, and D/A converters of the data drivers DRa and DRb subject the multiplexed image data to D/A conversion. Output circuits of the data drivers DRa and DRb output data signals DATAa and DATAb obtained by D/A conversion, as indicated by A5 and A6. A scan signal SCSEL input to the gate of the TFT of each pixel of the display panel goes active, as indicated by A7, and the data signal is input to and held by each pixel of the display panel.

In FIG. 22, the image data is read twice in the first horizontal scan period, and the data signals DATAa and DATAb are output to the data signal output line in the first horizontal scan period. Note that the image data may be read twice and latched in the first horizontal scan period, and the data signals DATAa and DATAb corresponding to the latched image data may be output to the data signal output line in the second horizontal scan period. FIG. 22 shows the case where the read count is RN=2. Note that the read count RN may be equal to or larger than three (RN≧3).

According to the method shown in FIG. 22, the image data corresponding to the data signals of 30 data lines is read from each memory block, and each of the data drivers DRa and DRb outputs the data signals of 30 data lines, as shown in FIG. 23. This allows the data signals of 60 data lines to be output from each data driver block. As described above, it suffices that the image data corresponding to the data signals of 30 data lines be read from each memory block in one read operation in FIG. 22. Therefore, the numbers of memory cells and sense amplifiers in the direction D2 in FIG. 23 can be reduced as compared with a method of reading the image data only once in one horizontal scan period. As a result, the width of the integrated circuit device in the direction D2 can be reduced, whereby a narrow chip can be realized. In particular, one horizontal scan period is about 52 microseconds in a QVGA display panel. On the other hand, the memory read time is about 40 nanoseconds, which is sufficiently shorter than 52 microseconds. Therefore, even if the read count in one horizontal scan period is increased from one to two or more, the display characteristics are not affected to a large extent.

FIG. 21A shows a QVGA (320×240) display panel. It is possible to deal with a VGA (640×480) display panel by increasing the read count in one horizontal scan period to four (RN=4), for example, whereby the degrees of freedom of the design can be increased.

Readings in one horizontal scan period may be achieved using a first method in which the row address decoder (wordline select circuit) selects different wordlines in each memory block in one horizontal scan period or a second method in which the row address decoder (wordline select circuit) selects a single wordline in each memory block a plurality of times in one horizontal scan period. Alternatively, readings in one horizontal scan period may be achieved by combining the first method and the second method.

In FIG. 23, the data driver block includes the data drivers DRa and DRb arranged along the direction D1. Each of the data drivers DRa and DRb includes driver cells.

When the wordline WL1*a* of the memory block has been selected and the first image data has been read from the memory block, as indicated by A1 in FIG. 22, the data driver DRa latches the read image data based on the latch signal LATa indicated by A3, and multiplexes the latched image data. The data driver DRa subjects the multiplexed image data to D/A conversion, and outputs the data signal DATAa corresponding to the first image data, as indicated by A5.

When the wordline WL1*b* of the memory block has been selected and the second image data has been read from the memory block, as indicated by A2 in FIG. 22, the data driver DRb latches the read image data based on the latch signal LATb indicated by A4, and multiplexes the latched image data. The data driver DRb subjects the multiplexed image data to D/A conversion, and outputs the data signal DATAb corresponding to the second image data, as indicated by A6.

Each of the data drivers DRa and DRb outputs the data signals of 30 data lines corresponding to 30 pixels as described above, whereby the data signals of 60 data lines corresponding to 60 pixels are output in total.

A situation in which the width W of the integrated circuit device in the direction D2 increases due to an increase in the scale of the data driver can be prevented by disposing (stacking) the data drivers DRa and DRb along the direction D1, as shown in FIG. 23. The data driver is configured in various ways depending on the type of display panel. In this case, data drivers of various configurations can be efficiently arranged using the method of disposing the data drivers along the direction D1. FIG. 23 shows the case where the number of data drivers disposed along the direction D1 is two. Note that three or more data drivers may be disposed along the direction D1.

In FIG. 23, each of the data drivers DRa and DRb includes 30 (Q) driver cells disposed along the direction D2. In FIG. 23, the number of pixels of the display panel in the horizontal scan direction (the number of pixels in the horizontal scan direction driven by each integrated circuit device when two or more integrated circuit devices cooperate to drive the data lines of the display panel) is referred to as HPN, the number of data driver blocks (number of block divisions) is referred to as DBN, and the input count of image data to the driver cell in one horizontal scan period is referred to as IN. The input count IN is equal to the image data read count RN in one horizontal scan period described with reference to FIG. 22. In this case, the number Q of driver cells may be expressed as Q=HPN/(DBN×IN). In FIG. 23, since HPN=240, DBN=4, and IN=2, Q=240/(4×2)=30.

The number of subpixels of the display panel in the horizontal scan direction is referred to as HPNS, and the degree of multiplexing of the multiplexer of each driver cell is referred to as NDM. In this case, the number Q of driver cells disposed along the direction D2 may be expressed as Q=HPNS/(DBN×IN×NDM). In FIG. 23, since HPNS=240×3=720, DBN=4, IN=2, and NDM=3, Q=720/(4×2×3)=30. For example, when the degree of multiplexing is increased to NDM=6, Q=720/(4×2×6)=15.

When the width (pitch) of the driver cells in the direction D2 is referred to as WD and the width of the peripheral circuit section (e.g. buffer circuit and wiring region) of the data driver block in the direction D2 is referred to as WPCB, the width WB (maximum width) of the first to Nth circuit blocks CB1 to CBN in the direction D2 may be expressed as $Q \times WD \leqq WB < (Q+1) \times WD + WPCB$. When the width of the peripheral circuit section (e.g. row address decoder RD and wiring region) of the memory block in the direction D2 is referred to as WPC, the width WB (maximum width) of the first to Nth circuit blocks CB1 to CBN in the direction D2 may be expressed as $Q \times WD \leqq WB < (Q+1) \times WD + WPC$.

When the number of pixels of the display panel in the horizontal scan direction is referred to as HPN, the number of bits of image data of one pixel is referred to as PDB, the number of memory blocks is referred to as MBN (=DBN), and the read count of image data from the memory block in one horizontal scan period is referred to as RN. In this case, the number of sense amplifiers (sense amplifiers which output one bit of image data) arranged in the sense amplifier block SAB along the direction D2 may be expressed as $P=(HPN \times PDB)/(MBN \times RN)$. In FIG. 23, since HPN=240, PDB=24, MBN=4, and RN=2, $P=(240 \times 24)/(4 \times 2)=720$. The number P is the number of effective sense amplifiers corresponding to the number of effective memory cells, and excludes the number of ineffective sense amplifiers such as sense amplifiers for dummy memory cells.

The number of subpixels of the display panel in the horizontal scan direction is referred to as HPNS, and the degree of multiplexing of the multiplexer of each driver cell is referred to as NDM. In this case, the number P of sense amplifiers disposed along the direction D2 may be expressed as $P=(HPNS \times PDB)/(MBN \times RN \times NDM)$. In FIG. 23, since $HPNS=240 \times 3=720$, PDB=24, MBN=4, RN=2, and NDM=3, $P=(720 \times 24)/(4 \times 2 \times 3)=720$.

When the width (pitch) of each sense amplifier of the sense amplifier block SAB in the direction D2 is referred to as WS, the width WSAB of the sense amplifier block SAB (memory block) in the direction D2 may be expressed as $WSAB=P \times WS$. When the width of the peripheral circuit section of the memory block in the direction D2 is referred to as WPC, the width WB (maximum width) of the circuit blocks CB1 to CBN in the direction D2 may also be expressed as $P \times WS \leqq WB < (P+PDB) \times WS + WPC$.

13. Electronic Instrument

Figure 24A:
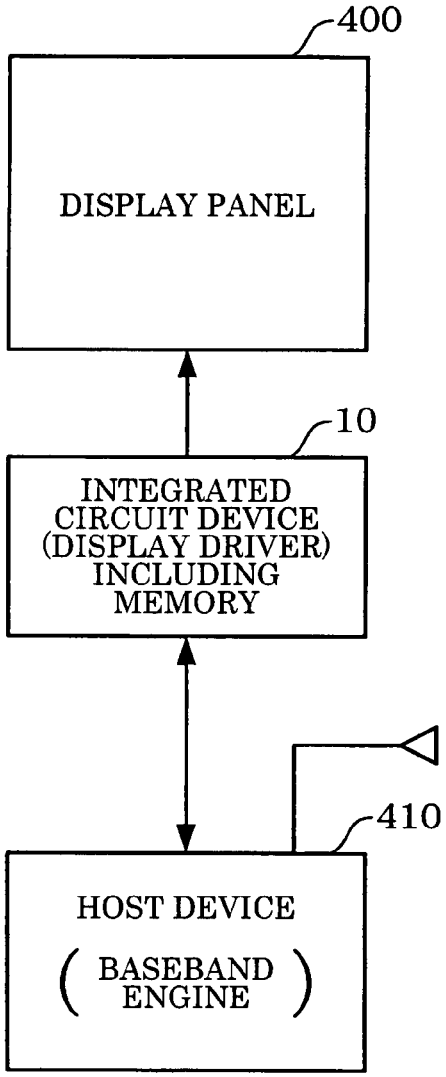
FIGS. 24A and 24B show configuration examples of an electronic instrument.
Figure 24B:
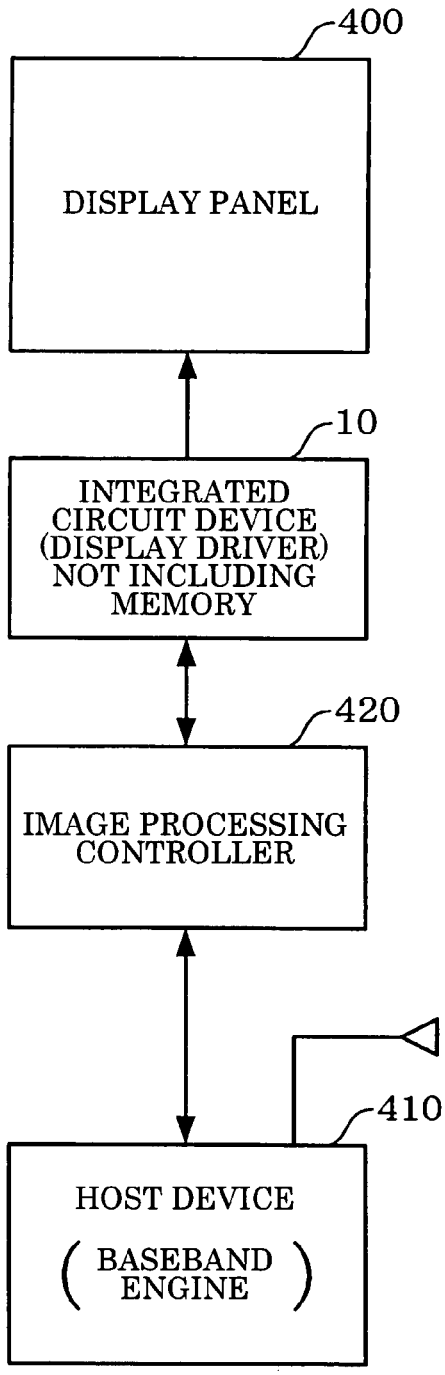

FIGS. 24A and 24B show examples of an electronic instrument (electro-optical device) including the integrated circuit device 10 according to this embodiment. The electronic instrument may include elements (e.g. camera, operation section, or power supply) other than the elements shown in FIGS. 24A and 24B. The electronic instrument according to this embodiment is not limited to a portable telephone, but may be a digital camera, a PDA, an electronic notebook, an electronic dictionary, a projector, a rear-projection television, a portable information terminal, or the like.

In FIGS. 24A and 24B, a host device 410 is an MPU, a baseband engine, or the like. The host device 410 controls the integrated circuit device 10 (display driver). The host device 410 may also perform a process of an application engine or a baseband engine or a process of a graphic engine, such as compression, decompression, and sizing. An image processing controller 420 shown in FIG. 24B performs a process of a graphic engine, such as compression, decompression, or sizing, instead of the host device 410.

In FIG. 24A, an integrated circuit device including a memory may be used as the integrated circuit device 10. In this case, the integrated circuit device 10 writes image data from the host device 410 into the memory, reads the image data from the built-in memory, and drives the display panel. In FIG. 24B, an integrated circuit device which does not include a memory may be used as the integrated circuit device 10. In this case, image data from the host device 410 is written into a built-in memory of the image processing controller 420. The integrated circuit device 10 drives the display panel 400 under control of the image processing controller 420.

Although only some embodiments of the invention have been described in detail above, those skilled in the art would readily appreciate that many modifications are possible in the embodiments without materially departing from the novel teachings and advantages of the invention. Accordingly, such modifications are intended to be included within the scope of the invention. Any term (e.g., output-side I/F region, input-side I/F region, and liquid crystal element) cited with a different term (e.g., first interface region, second interface region, and electro-optical element) having a broader meaning or the same meaning at least once in the specification and the drawings can be replaced by the different term in any place in the specification and the drawings. The scan output line wiring method described with reference to FIGS. 1 to 5 and the common voltage line wiring method described with reference to FIGS. 6A to 11C may be applied not only to the integrated circuit device having the arrangement configuration described with reference to FIGS. 14 to 16A, but also to integrated circuit devices having other arrangement configurations. For example, the methods may be applied to the integrated circuit device having the arrangement configuration shown in FIG. 16B. The scan output lines may be provided in a region other than the link controller in order to avoid the physical layer circuit.

What is claimed is:

1. An integrated circuit device comprising:

a common voltage generation circuit that generates a common voltage applied to a common electrode of a display panel;

a high-speed interface circuit block that includes a physical layer circuit and transfers data through a serial bus using differential signals;

at least one data driver block that drives a plurality of data lines of the display panel, the at least one data driver block being disposed between the common voltage generation circuit and the high-speed interface circuit block;

first and second common voltage pads that output the common voltage generated by the common voltage generation circuit to the outside, the first and second common voltage pads being connected to the common voltage generation circuit, when a direction from a first side as a short side of the integrated circuit device toward a third side opposite to the first side is referred to as a first direction, a direction from a second side as a long side of the integrated circuit device toward a fourth side opposite to the second side is referred to as a second direction, a direction opposite to the first direction is referred to as a third direction, and a direction opposite to the second direction is referred to as a fourth direction, the first common voltage pad being disposed in the third direction with respect to the data driver block, and the second common voltage pad being disposed in the first direction with respect to the data driver block, first and second differential input pads to which first and second signals forming the differential signals are input from the outside being disposed in the fourth direction with respect to the physical layer circuit, the serial bus being connected to the first and second differential input pads, the first and second differential input pads being connected to the physical layer circuit of the high-speed interface circuit block, and a common voltage line connecting the first and second common voltage pads being provided from the first common voltage pad to the second common voltage pad along the first direction, the common voltage line being disposed along the first direction in a first region, the first region being a region provided in the second direction with respect to the physical layer circuit.

2. The integrated circuit device as defined in claim 1, the common voltage line being disposed along the first direction in a second region, the second region being a region provided in the fourth direction with respect to the data driver block.

3. The integrated circuit device as defined in claim 1, the high-speed interface circuit block including a link controller that is disposed in the second direction with respect to the physical layer circuit and performs a link layer process that analyzes a packet received through the physical layer circuit, and the common voltage line being disposed along the first direction in a third region, the third region being a region provided in the second direction with respect to the link controller.

4. The integrated circuit device as defined in claim 1, the common voltage generation circuit being disposed in the third direction with respect to the data driver block.

5. The integrated circuit device as defined in claim 1, the integrated circuit device including a first shield line formed of an interconnect layer in a layer differing from the common voltage line and provided with a given power supply potential, the first shield line being provided to overlap the common voltage line in plan view.

6. The integrated circuit device as defined in claim 1, the integrated circuit device including second shield lines formed of an interconnect layer in the same layer as the common voltage line and provided with a given power supply potential, the second shield lines being provided on either side of the common voltage line.

7. The integrated circuit device as defined in claim 1, the integrated circuit device comprising:

first to Nth circuit blocks (N is an integer equal to or larger than two) disposed along the first direction, the first to Nth circuit blocks including:

the data driver block;

a grayscale voltage generation circuit block that generates grayscale voltages; and a logic circuit block that receives data received by the high-speed interface circuit block and transfers grayscale adjustment data for adjusting the grayscale voltages to the grayscale voltage generation circuit block;

the grayscale voltage generation circuit block being disposed in the third direction with respect to the data driver block, and the high-speed interface circuit block and the logic circuit block being disposed in the first direction with respect to the data driver block.

8. The integrated circuit device as defined in claim 1, the integrated circuit device comprising:

first to Nth circuit blocks (N is an integer equal to or larger than two) disposed along the first direction, the first to Nth circuit blocks including:

the data driver block;

a power supply circuit block that generates a power supply voltage; and a logic circuit block that receives data received by the high-speed interface circuit block and transfers power supply adjustment data for adjusting the power supply voltage to the power supply circuit block;

the power supply circuit block being disposed in the third direction with respect to the data driver block, and the high-speed interface circuit block and the logic circuit block being disposed in the first direction with respect to the data driver block.

9. An electronic instrument comprising:

the integrated circuit device as defined in claim 1; and a display panel driven by the integrated circuit device.

* * * * *